US010204472B1

(12) United States Patent
Halvorson et al.

(10) Patent No.: US 10,204,472 B1
(45) Date of Patent: Feb. 12, 2019

(54) GAMING SYSTEM AND METHOD HAVING SYMBOL TYPE CONVERSION

(71) Applicant: ADP GAUSELMANN GMBH, Espelkamp (DE)

(72) Inventors: Michael Charles Halvorson, Las Vegas, NV (US); Josef Alexander Hartl, Las Vegas, NV (US)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

(21) Appl. No.: 15/723,162

(22) Filed: Oct. 2, 2017

(51) Int. Cl.
*G07F 17/32* (2006.01)

(52) U.S. Cl.
CPC ..... *G07F 17/3209* (2013.01); *G07F 17/326* (2013.01); *G07F 17/3213* (2013.01); *G07F 17/3223* (2013.01); *G07F 17/3244* (2013.01)

(58) Field of Classification Search
CPC ..... G07F 17/326; G07F 17/3288; G07F 17/3266; G07F 17/34
See application file for complete search history.

(56) References Cited

U.S. PATENT DOCUMENTS 6,780,109 B2 8/2004 Kaminkow
6,866,583 B2 3/2005 Glavich et al.
6,921,335 B2 7/2005 Rodgers et al.
6,997,808 B2 2/2006 Rodgers et al.
7,070,502 B1 7/2006 Bussick et al.
7,137,888 B2 11/2006 Glavich et al.
7,226,359 B2 6/2007 Bussick et al.
7,252,592 B2 8/2007 Rodgers et al.
7,399,225 B2 7/2008 Kaminkow
7,481,709 B2 1/2009 Bussick et al.
8,408,987 B2 4/2013 Kaminkow
8,747,214 B2 6/2014 Kaminkow
2003/0064802 A1* 4/2003 Rodgers ..... G07F 17/3265 463/30
2006/0068881 A1* 3/2006 Casey ..... G07F 17/3265 463/20
2009/0305770 A1* 12/2009 Bennett ..... G07F 17/32 463/20
2010/0016061 A1* 1/2010 Gomez ..... G07F 17/3267 463/20
2013/0344939 A1* 12/2013 Aoki ..... G07F 17/326 463/21

(Continued)

*Primary Examiner* — James S McClellan
*Assistant Examiner* — Kevin Carter
(74) *Attorney, Agent, or Firm* — Resolute Legal PLLC

(57) ABSTRACT

The gaming system and method includes a symbol type conversion. The gaming system includes a set of reels, where the reels are each associated with a plurality of symbols from a set of symbols. During a game play, the gaming system randomly generates a plurality of symbols from the set of symbols for the reels. Each symbol is associated with a symbol type. The gaming system randomly selects a first symbol from the set of symbols associated with a first type of symbol. The first symbol may convert to a second symbol associated with a second symbol type, based on a symbol conversion mapping. In some embodiments, if the conversion results in a player benefit, the gaming system replaces at least one displayed first symbol with a display of the second symbol on the reels. The gaming system analyzes the displayed symbols for winning symbol combinations for player awards.

20 Claims, 15 Drawing Sheets

(56) References Cited

U.S. PATENT DOCUMENTS

| | | | | |
|---|---|---|---|---|
| 2014/0087833 | A1* | 3/2014 | Berman | G07F 17/3244 463/20 |
| 2015/0199867 | A1* | 7/2015 | Vermaak | G07F 17/3213 463/20 |
| 2018/0130307 | A1* | 5/2018 | Lamb | G07F 17/3267 |

* cited by examiner

GAMING SYSTEM AND METHOD HAVING SYMBOL TYPE CONVERSION

FIELD OF THE INVENTION

The present disclosure relates to gaming devices.

SUMMARY OF THE INVENTION

Various embodiments of a gaming system and method are disclosed as having symbol type conversions. The gaming system includes a set of symbols having a plurality of symbols. Each of the plurality of symbols is associated with a symbol type. The set of symbols includes a plurality of different symbol types. The gaming system randomly selects a first symbol from the set of symbols based on the first symbol's associated symbol type. If the first symbol is generated and displayed during a play of a game, the gaming system may convert the first symbol into a second symbol of the set of symbols. The second symbol is associated with a symbol type that is different from the symbol type of the first symbol. The gaming system determines the conversion from the first symbol to the second symbol based in part on the symbol type of the second symbol.

In one embodiment, the gaming system includes a set of symbols. The set of symbols includes a plurality of different symbols. Each of the symbols in the set of symbols is associated with a symbol type. The set of symbols includes a plurality of different symbol types. The gaming system randomly selects at least one symbol from the set of symbols based on the symbol type of the at least one symbol. During a play of a game, the gaming system generates and displays a plurality of symbols from the set of symbols. The gaming system determines if the selected at least one symbol is generated. If the selected at least one symbol is generated, the gaming system converts the selected at least one symbol to a second symbol of the set of symbols. The gaming system may use one or more predetermined symbol type conversion maps to determine the second symbol to use for the conversion. The second symbol is associated with a second symbol type of the set of symbols. The symbol type of the second symbol differs from the symbol type of selected at least one symbol. The gaming system may determine not to convert the selected at least one symbol to the second symbol if the second symbol creates a displayed symbol combination that results in the same or fewer winning symbol combinations than when the at least one symbol is displayed.

In one embodiment, the gaming system stores a conversion map between symbols in the set of symbols. The gaming system may use the conversion map to determine which symbol in the set of symbols to use for a conversion. In one embodiment, each symbol in the set of symbols is mapped to one other symbol in the set of symbols.

In some embodiments, the mapping between two symbols symbol is between symbols having symbol types that are different from each other. In one such embodiment, some symbols in the set of symbols are classified as a pay type (i.e., a pay symbol) while other symbols in the set of symbols are classified as a special type (i.e., a special symbol). It should be appreciated that any suitable symbol types and any number of different suitable symbol types can be used for symbol mappings.

In one embodiment, a symbol classified as a pay symbol may be assigned a value. For example, a bar symbol may be assigned a value of two credits. If a gaming system displayed three adjacent bar symbols along a wagered pay line, the gaming system pays out six credits (two credits for each adjacent bar symbol displayed on the wagered pay line). As another example, a cherry symbol may be assigned a value of four credits. If a gaming system displayed three adjacent cherry symbols along a wagered pay line, the gaming system pays out 12 credits (four credits for each adjacent cherry symbol displayed on the wagered pay line). A plurality of different pay symbols may be included in the set of symbols. The set of symbols may also include a plurality of different value pay symbols.

In one embodiment, a symbol classified as the special symbol may be assigned one or more functions, alone or in combination with other symbols, to provide or trigger special game functions. Special symbols may trigger the gaming system to perform a special function when such special symbols are generated and visibly displayed on a stopped reel. For example, a bonus trigger symbol (a special symbol) may be associated with causing the gaming system to initiate a bonus game. In another example, a 4× multiplier symbol (another special symbol) may be associated with causing the gaming system to multiply any awards by four. A plurality of different special symbols may be included in the set of symbols.

In one embodiment, where a mapping between two symbols is between symbols having symbol types that are different from each other, the gaming system may convert a generated pay symbol into a special symbol. For example, the gaming system may convert a bar symbol (a pay symbol) into a bonus trigger symbol (a special symbol). In one such embodiment, the gaming system does not convert a pay symbol into another pay symbol. However, in other embodiments, the gaming system may convert a pay symbol into another pay symbol.

In some embodiments, the mapping between two symbols is between symbols having symbol types that are the same. In one such embodiment, the gaming system may convert a displayed pay symbol into a different pay symbol. In some such embodiments, the mapping between two symbols with the same symbol type is between symbols with different assigned values. For example, if a bar symbol (a pay symbol) is assigned a value of two and a cherry symbol (another pay symbol) is assigned a value of four, these pay symbols have different assigned values. In other words, the gaming system may convert a bar symbol into a cherry symbol. In one embodiment, the conversion mapping between symbols of the same symbol type includes only mapping symbols with lower values to symbols with higher values. That is, a conversion will only occur from a lower value symbol to a higher value symbol. However, it should be appreciated that the conversion could be reversed in some embodiments (the gaming system converting a higher value symbol to a lower value symbol). In another embodiment, the gaming system may convert a displayed special symbol into another special symbol.

It should be appreciated that the mappings between symbols may include any suitable combination of the above discussed conversion mappings. In some embodiments, the conversion mapping between symbols is predetermined. In other embodiments, the conversion mapping between symbols is randomly determined. The random determination of the symbol mappings may occur before or during a play of a game.

In some embodiments, the gaming system may use more than one conversion map in a play of a game. For example, the gaming system may store a first symbol conversion map that maps a bar symbol (a pay symbol) to a bonus trigger symbol (a special symbol). The gaming system may also store a second symbol conversion map that maps the bar symbol (a pay symbol) to a cherry symbol (another pay symbol). In one such embodiment, the gaming system may apply the first symbol conversion mapping to a first set of gaming reels (such as reels 1, 3 and 5 of a 5 reel gaming system) while applying the second symbol conversion mapping to a second set of the gaming reels (such as reels 2 and 4 of the 5 reel gaming system). Thus, in a play of a game where the gaming system generated bar symbols on reels 1 and 2, the gaming system may apply the first conversion mapping to the bar symbols on reel 1 while applying the second symbol conversion mapping to bar symbols on reel 2 (depending on whether the bar symbol is randomly selected for conversion).

A gaming system and method with symbol type conversions, with a potential to earn greater awards, creates a greatly improved sense of anticipation for players. A gaming system with the symbol type conversions enables players to recognize that a gaming system which generates and displays many common symbols may have a greater possibility of an improved award because the many common symbols could be converted into different and better symbols.

DETAILED DESCRIPTION OF THE INVENTION

Figure 1:
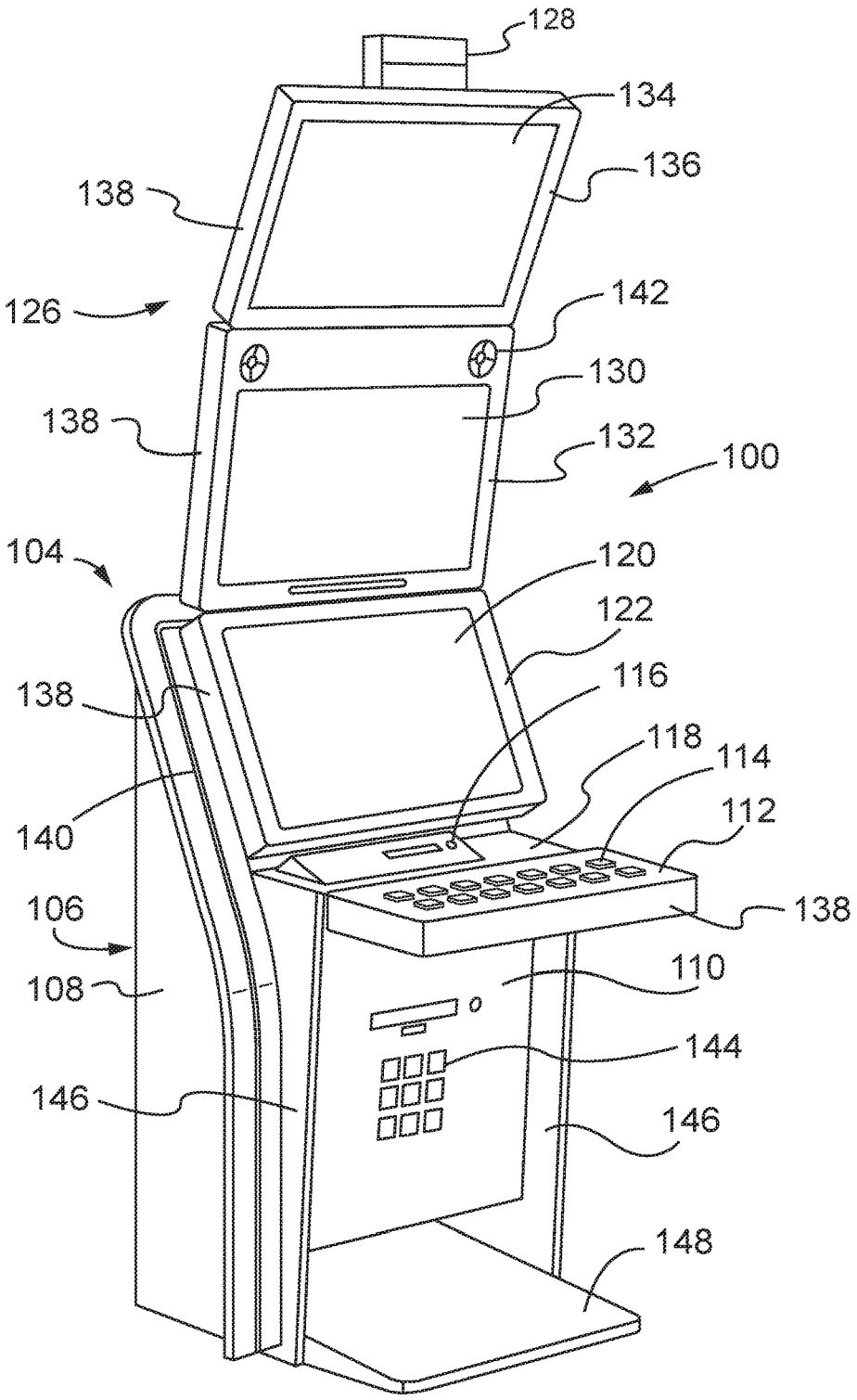
FIG. 1 is a perspective view of one embodiment of a stand-alone gaming device of a gaming system.

Various embodiments of a gaming system and method are disclosed as having symbol type conversions. The gaming system randomly selects, from a set of symbols, a first symbol associated with a first symbol type. For a play of a game, the gaming system randomly generates and displays a plurality of symbols from the set of symbols. If the selected first symbol is among the plurality of generated symbols, the gaming system may convert at least one of the generated first symbols from the plurality of displayed symbols into a second symbol of the set of symbols. The second symbol is associated with a second symbol type. The gaming system may use a conversion mapping between symbols to determine which second symbol to use for the conversion.

In an embodiment of one method of operating the gaming system, the gaming system may receive a monetary value from a player via a value acceptor device. The gaming system may determine, via a processor of the gaming device, a credit balance based on the monetary value received. The gaming method and system may receive, via a player input device, a wager for a play of a game at the gaming device. The gaming system may use a processor of the gaming device to update a gaming credit balance in accordance with the amount of the wager. The gaming system may receive, via a player input device, a request to initiate a play of the game. The gaming system may use a random number generator to randomly generate a plurality of symbols from a set of symbols for each game reel of a first set of reels. The gaming system may display the randomly generated plurality of symbols in a visible symbol display area. The gaming system may also use the random number generator to randomly select a symbol from the set of symbols. The gaming system may evaluate whether the selected symbol is present in the randomly generated plurality of symbols. If the selected symbol is present in the randomly generated plurality of symbols, the gaming system may evaluate, using a processor of the gaming device, whether to convert the selected symbol to another symbol of the set of symbols. The conversion may be based on a conversion mapping between symbols in the set of symbols and based on symbol types in the set of symbols. The gaming system may also determine if the symbol conversion will benefit the player, such as by increasing a game award to the player. If it is determined that symbol type conversion does not benefit a player, the gaming system evaluates the displayed symbols for winning symbol combinations along wagered pay lines. If a symbol type conversion results in a player benefit, the gaming system may execute the symbol type conversion. The gaming system may cause a display device to display a symbol type conversion where the selected first symbol is converted to a second symbol. The gaming system may then evaluate, by the processor of the gaming device, the displayed symbols (including the converted second symbols) for winning symbol combinations along wagered pay lines. The gaming system may update, by the processor of the gaming device, the gaming credit balance in accordance with any award amount based on the winning symbol combinations. The gaming system can dispense a value to the player via a value dispenser of the gaming device in accordance with the player gaming credit balance when receiving a signal to cash out or otherwise end the gaming session at the gaming device.

Gaming Device Platform

The features and advantages of the gaming system and method described herein may be provided to a player via a gaming device platform that includes various structures and components for allowing player interaction with the gaming device. While only one gaming device platform will be described in detail herein, the features, objects, and advantages of the gaming system described herein may be implemented in one or more alternative gaming device platforms.

One embodiment of a gaming device platform is shown in FIG. 1 where a gaming device 100 is generally shown. In one embodiment, the gaming device 100 is referred to as a slot machine and is illustrated as housed in a housing or cabinet constructed so that a player can operate and play the gaming device 100 while standing or sitting.

Gaming device 100 may include cabinet 104 for housing the components fully described hereinbelow. The cabinet 104 has a lower cabinet body portion 106 which includes a pair of cabinet side panels 108 (only one of which is viewable in the perspective view of FIG. 1), front panel 110, and a rear panel (not shown). A base panel (not shown) and a top panel surface (not shown) that supports first game display 120 and the player interaction area 112, are provided. The cabinet panels are interconnected along their edges and cooperate to form a cabinet enclosure for housing the gaming device, as can be seen in FIG. 1.

It should be appreciated that a wide variety of cabinet enclosure sizes, shapes, and designs are possible for the gaming device 100. Cabinet 104 may function to securely protect any local control system, technology components, and provide support for game display(s) and player input and output interactions with the gaming device.

Returning to FIG. 1, the gaming device enables the player to interact with the gaming device 100 to direct the wagering and game play activities and preferences. Various forms of player interaction devices and activities will now be described.

Cabinet 104 includes a player interaction area having input and output areas generally designated as 112. The player interaction area 112 may be located on the front top side of cabinet 104 and, as shown, on a panel structure that extends outwardly from the gaming device in a player's direction. Player interaction area 112 may contain a plurality of player input and output structures such as player control button area 114, player value acceptor and dispenser area 116, and player convenience input area 118.

Player control button area 114 includes a plurality of buttons, touch sensitive areas, or both through with which players may interact with the one or more processors of gaming device 100 and direct game play. It is expected that cabinet 104 provides an easily accessible location and support for all necessary player input/output (I/O) interactions with the device, including gaming control interactions and value wagering interactions. Although the gaming device 100 illustrated in FIG. 1 shows player controls provided by buttons of player control button area 114, it is understood that in one embodiment, a player's gaming control interactions could be made by either buttons mounted on cabinet 104 or "soft" buttons located on the gaming display and activated by player touch (e.g., touch screen interfaces), or a combination of both arrangements.

Player control button area 114 may include, for example: game selection button(s) in any embodiments where more than one game is provided in a single gaming device; gaming denomination value selection button(s) in any embodiments where one or more wagering denomination value is accommodated; wager selection button(s) for the player to indicate or select the desired wager value for a game in any embodiments where a selection of wager values are offered; pay line selection button(s) for selecting the number of active pay lines in game embodiments that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information. As discussed above, the functions of the buttons in player control button area 114 may be duplicated with soft buttons in the player control button area 114 or as soft buttons in other areas of the gaming device 100 (e.g., as a touch screen overlay over available game displays).

Gaming device 100 may include one or more forms of value acceptance and value distribution to allow the player to interact with the device and to risk or otherwise place a wager (a monetary value) on one or more outcomes of a game. Winnings may be returned to the player via some form of value distribution. As illustrated in FIG. 1, player value acceptor and dispenser area 116 is provided. In the player value acceptor and dispenser area 116, a player supplies monetary value to the gaming device 100 via one or more value acceptor devices. In one embodiment, the player value acceptor and dispenser area 116 (through the one or more value acceptor devices) may accept any one or more of the following from a player to establish a gaming credit balance: coins, bills, tokens, tickets/vouchers, player ID cards, credit cards, or other suitable forms of value. Thus, if the gaming device 100 accepts coins and bill, the gaming device 100 includes a currency bill validator and a coin validator as the value acceptor devices. Likewise, if the gaming device 100 accepts tickets, the gaming device includes a ticket acceptor as a value acceptor device for receiving tickets or vouchers representing some monetary value. The ticket acceptor may include a bar code reader, or other appropriate code reader, for reading the encoded value contained by the player's ticket or voucher. In some embodiments, the player value acceptor and dispenser area 116 may include a value acceptor device that can accept more than one type of value. In some embodiments, the player value acceptor and dispenser area 116 may include multiple different value acceptor devices to accept different types of value from players Upon receipt of some type of value from the player, a value acceptor device of the player value acceptor and dispenser area 116 performs validation on the player supplied value using appropriate hardware readers (e.g., determining that the currency bills/coins/tokens are genuine or the ticket/voucher is genuine). If the validation result is positive on player supplied value, the appropriate value acceptor device generates a signal to a processor of the gaming device 100 to establish a gaming credit balance for plays of one or more games on gaming device 100.

In one embodiment, a player receives monetary value, or a representation thereof, from the gaming device 100 when a player chooses to "cash out" the gaming credit balance (e.g., remove value from the gaming device 100). The player can cash out at any suitable time. When a player cashes out the value contained on a credit meter (not shown) of gaming device 100, a processor of gaming device 100 may cause a printer of gaming device 100 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming device 100 may cause a currency bill dispenser or a coin dispenser in gaming device 100 to dispense the value contained on the credit meter of gaming device 100.

Various combinations of the above value acceptance and value distribution arrangements are possible. Gaming device 100 may include other value acceptance and value distribution mechanisms in the player value acceptor and dispenser area 116. For example, gaming device 100 may include a magnetic strip or chip card reader/writer in order to accept value from and transfer value to a magnetic strip or an embedded chip card. In other embodiments, hardware for transferring (and receiving) non-traditional currencies to players such as digital currencies (e.g., bitcoin) may be included in gaming device 100.

In an alternative embodiment, gaming device 100 may include a card reader (not illustrated) in the in the player value acceptor and dispenser area 116, which accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming device may be associated with the player account. It is noted that a numeric or alphanumeric keypad may be provided adjacent to the card reader slot to enable player entry of a personal identification number or the like for secure access to card information.

In one embodiment, a player convenience input area 118 may be included in the gaming device 100, as is shown in FIG. 1. In various embodiments, player convenience input area 118 may have a variety of features and functions depending on the jurisdictional deployment of the gaming device 100. In one embodiment, the player convenience input area 118 will house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into a gaming device during play. These player loyalty/player tracking cards are associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain embodiments, the player convenience input area 118 may include player convenience features such as a pocket for storage that allows players to store their personal items such as a mobile phone. Gaming device 100 may include one or more universal serial bus (USB) ports that enables a player to charge their electronics or connect to services such as the Internet or food service. Further, player convenience input area 118 of gaming device 100 may include buttons to request food or drink service if the gaming device is located in an establishment that has food and drink service. The gaming device 100 may be connected to a local or wide area network such that selection of the requested food or drink service will alert the establishment's hospitality staff to deliver the requested service directly to the gaming device 100.

The layout of the player control button area 114, player value acceptor and dispenser area 116 and the player convenience input area 118 in gaming device 100 may be arranged differently than those disclosed and illustrated herein. The selections and arrangement of input locations on the cabinet 104 may be dependent upon the game buttons, the type of value wagered, and the player conveniences utilized in the deployment configuration of gaming device 100.

With continuing reference to FIG. 1, in one embodiment, lower cabinet body portion 106 includes a first game display 120 mounted atop or flush with the lower cabinet body portion's top panel surface. First game display 120 is, for example, a 27-inch liquid crystal display (LCD) display mounted in a widescreen orientation. However, any suitable display may be used in any suitable orientation. In the illustrated embodiment, the first game display 120 is mounted within and framed by first display frame 122 which is, in turn, mounted upon lower cabinet body portion's top panel surface. In this manner, the first game display 120 is both surrounded and secured within the first display frame 122 and raised above the cabinet's top panel surface. Additional features of the first display frame 122 will be described below. In one embodiment, gaming device 100 may use one first game display 120 and not include additional game displays (not illustrated).

The lower cabinet body portion 106 is further constructed to support upper cabinet portion 126. Upper cabinet portion 126 may be comprised of an upwardly extending support structure (not illustrated) that extends upwardly from the rear side of lower cabinet body portion 106 and is sufficiently strong to support one or more additional game displays.

At the topmost end of the support structure, a cabinet top light 128 may be provided. The cabinet top light 128 is capable of illumination in a variety of colors and is utilized to indicate and communicate gaming device conditions to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In one embodiment, as illustrated in FIG. 1, gaming device 100 includes two additional displays, second game display 130 and third game display 134. Second game display 130 and third game display 134 are disposed generally in a vertical relationship and generally in alignment with the first game display 120. Like the first game display 120, second game display 130 and third game display 134 can be 27-inch LCD displays and can be mounted in a widescreen orientation in one embodiment. However, any suitable display in any suitable orientation may be used for the second game display 130 and the third game display 134. Further, like the first game display 120, second game display 130 and third game display 134 can be mounted within and framed by second display frame 132 and third display frame 136, respectively. Second display frame 132 and third display frame 136 are attached to the upper cabinet support structure and can protect the second game display 130 and the third game display 134.

First game display 120, second game display 130, and third game display 134 can be disposed at an angle from each other to form a player-facing concave arc. However, in some embodiments, the angles between the displays may be adjustable and may be smaller or greater than the angles illustrated in FIG. 1. Further, it is understood that in some embodiments the displays may be disposed in a common plane relative to each other.

It also should be appreciated that in various embodiments a variety of display technology may be utilized equivalently and interchangeably with a variety of embodiments of the gaming device. Equivalent display devices include all variations of liquid crystal displays, light emitting diode displays, and plasma displays.

In some embodiments, different sized displays may be combined to display gaming data on gaming device 100. As a non-limiting example, a 27-inch widescreen LCD display may be combined with a 20-inch portrait oriented LCD or a light emitting diode (LED) display. This combination may be used, for example, with a third scrolling banner LED display. In alternative embodiments, one, two, three, or more displays could be used in a variety of positions and orientations. Any suitable combination may be used. It should also be appreciated that a processor of gaming device 100 may communicate with the disclosed first game display 120, second game display 130, and third game display 134 through a video card of gaming device 100 to produce the visible aspects of a game.

In one embodiment, one or more of the first game display 120, second game display 130, and third game display 134 may be fitted with a transparent touch sensitive overlay for sensing player touch inputs into the gaming device. Touch sensitive overlays can communicate with a processor of gaming device 100 to enable the player to interact with the game.

In some embodiments, the curved displays may be used for any or all of the first game display 120, second game display 130, or third game display 134. Similarly, any of the displays used for gaming device 100 can be based on flexible display technologies. For example, it is possible to utilize flexible display technologies to create uniquely shaped curving, wavy, or tubular display structures to provide one or more of the first game display 120, second game display 130, and third game display 134. Additionally, in one embodiment flexible display technologies can be used in combination with fixed flat screen technologies.

While the gaming device 100 has been described as implemented with video technologies, in one embodiment, mechanical reels with reel strips containing game indicia and step motor controllers may be employed to provide game information to a player. In one embodiment, the reel strips may include a plurality of printed symbols. In another embodiment, the mechanical reels may include flexible video display technology as the reel strips on mechanical reels. Thus, games implemented in video form can readily be implemented with mechanical reels utilizing such display technology. Alternatively, in other embodiments mechanical reels with reels strips having fixed symbols displayed along the reel strip could be used to implement the game.

Dependent upon the particular gaming device housing style, a variety of other display technologies may be utilized in combination with the gaming device disclosed herein. For example, in some embodiments a gaming device may have one or more display devices in addition to the main game display(s). For example, the gaming device may include a player tracking device having a player tracking display which displays various information to the player regarding the player's status. The gaming device may also include other game-related displays such as the wager display and the gaming credit balance display. These additional game-related displays may be separate display devices or may be displayed on any one or more of the first game display 120, the second game display 130, or the third game display 134.

Cabinet lighting design functions to attract players to a gaming device 100. In the embodiment of FIG. 1, attractive cabinet lighting is provided by frame accent lighting 138. It is noted that frame accent lighting 138 is a common structure found on each of the first display frame 122, the second display frame 132, and the third display frame 136 and player interaction area 112. Example areas where frame accent lighting is applied to gaming device 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In one embodiment, the circuit boards are flexible circuit boards. These LED strips and transparent or translucent coverings may surround one or more gaming device displays frames, as well as the player interaction area, to highlight these areas.

In one embodiment, the individual LEDs mounted on the LED strips are of a type that can emit red, green, and blue light. In an alternative embodiment, separate LEDs are used for each required light color. All LED strips can be electrically connected and can be controlled by a cabinet lighting controller 218 (illustrated in FIG. 2) in conjunction with a processor of gaming device 100 to selectively mix the emitted light colors in a manner to create any color. The cabinet lighting controller 218 can flash and vary lighting as desired. For example, cabinet edge lighting can change and flash in combination with music rhythms or in combination with game events. Other variations are possible.

In some embodiments, cabinet 104 may include LED strip lighting or LED rope lighting to accentuate the cabinet and enhance the attractiveness of gaming device 100 to players. LED rope lighting is a plurality of small light-emitting diode bulbs linked together and encased in a plastic, polyvinylchloride, or other suitable material to create a string of lights. For example, in the embodiment of FIG. 1, cabinet 104 includes cabinet accent lighting 140. In one embodiment, cabinet accent lighting 140 is LED rope lighting mounted flush with the front side edge of the cabinet side panels 108. The LED rope lighting can generate any of suitable colors, and are controlled by cabinet lighting controller 218 and a processor of gaming device 100 to selectively mix the emitted light colors in a manner to create any color in the same manner as the frame edge lighting.

In various embodiments, gaming device 100 includes one or more audio speakers and appropriate driving electronics and sound cards so that game players may experience pleasing audio aspects of the gaming device 100. Audio is desirable to attract and maintain player interest in gaming device 100. Gaming device 100 may also emit attraction sounds during any idle period of gaming device 100. Game audio may add to the player's enjoyment of gaming device 100 by providing music and sound effects designed to enhance and compliment the gaming experience.

Audio speaker hardware may include one or more speakers disposed in or on the cabinet 104 of gaming device 100. In FIG. 1, a pair of audio speakers 142 are shown mounted on the upper corners of second display frame 132. Any suitable number of additional speakers may be provided on additional display frames or on the lower cabinet body portion 106 as desired.

Speakers designed for emitting bass vibrations may be included in some embodiments. Speaker placement may be selected to enhance the sound emitting characteristics of the gaming device. For example, bass speakers or additional speakers 144 may be mounted inside lower cabinet body portion 106. Further, it is envisioned that in some embodiments sound processing such as multichannel processing and surround sound processing are included in gaming device 100. Audio jacks for attachment of player headphones may also be provided in some embodiments of gaming device 100 for the player to further enhance the audio experience of the game and also to block out noise from other gaming devices.

In one embodiment, front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing gaming device 100 in a seated position. Foot rest 148, which may be cushioned, is provided below player interaction area 112 to enhance a player's ergonomic comfort while playing gaming device 100. In one embodiment, the edges of player interaction area 112 may be ergonomically cushioned as well.

Gaming device 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary 3) provide an easy location and support for all necessary player input/output (I/O) interactions, including gaming control interactions and value wagering interactions. For example, in some embodiments the gaming device 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In one embodiment, housing styles of cabinet 104 of gaming device 100 may include bar top or table top housing arrangements. These housings are generally small enough to be placed on top of an existing bar or table while providing the requisite gaming device housing functions of protection of/access to gaming electronics, displays, and player I/O functions described above.

In one embodiment, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
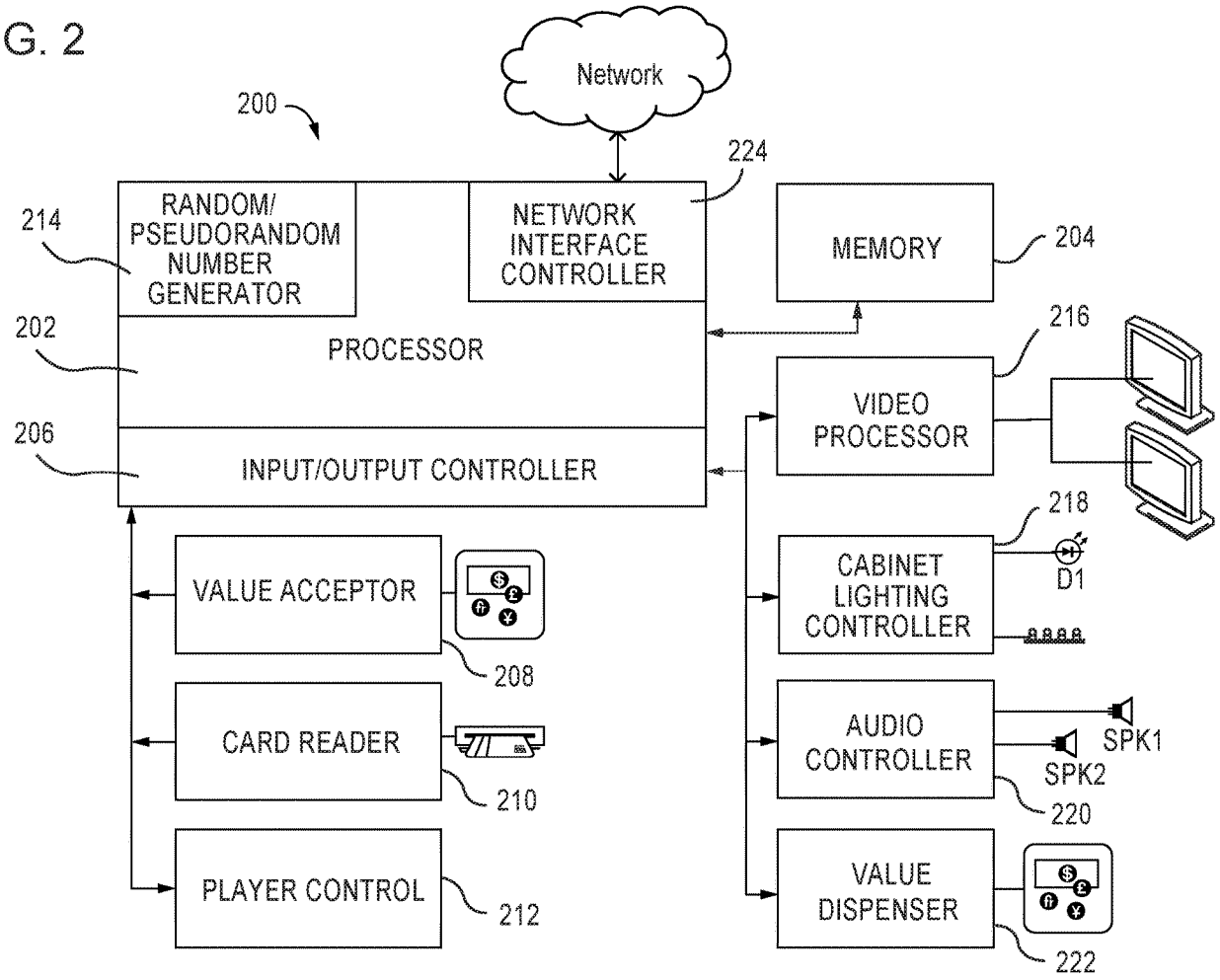
FIG. 2 is a functional block diagram of the gaming device technology components of the gaming system.

Turning now to FIG. 2, the features and advantages of the gaming system described above will now be described in terms of the various technology components for allowing player interaction with the gaming device 100.

FIG. 2 illustrates a functional block diagram of an embodiment of technology components of gaming device 100 that are specially configured to carry out the game function and operations described herein. The functional elements shown in FIG. 2 cooperate, on a broad and general level, to function as gaming device 100. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In one embodiment, gaming device 100 is functionally controlled by control unit 200. Control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one embodiment, control unit is also configured to communicate with a server device through a network.

In one embodiment, control unit 200 includes at least one specially configured processor 202 or central processing unit (CPU). In one embodiment, specially configured processor 202 include arithmetic logic units and math co-processors also known as floating point units. In one embodiment, specially configured processor 202 includes registers for holding instructions or other data, and cache memory for storing data for faster operation thereupon. In one embodiment, specially configured processor 202 may be a multi-core processor that includes two or more processors for enhanced performance, more efficient parallel processing, or other advantageous computing functions. In another embodiment, specially configured processor 202 may be one or more processing devices such as microprocessor(s) or integrated circuit(s) and may include one or more controllers. It should be appreciated that in some embodiments, a general purpose processor could be programmed to perform the functions of specially configured processor 202.

A controller, in one embodiment, is a device or a software program that manages or directs the flow of data between two entities. Often, controllers are special purpose circuitry or software that solve a technical communications problem between different technology systems. In one embodiment, a controller functions as an interface between two systems while managing the communications between the systems. In another embodiment, a controller functions as an interface between a processor and a peripheral device and functions to control the peripheral device.

At least one specially configured processor 202 or controller of control unit 200 is specially configured to communicate with at least one memory device, generally shown as memory device 204 in FIG. 2. In one embodiment, memory device 204 includes one or more memory structures for storing instructions and various types of game data. Memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in one embodiment, communication with a memory device by a processor or a controller encompasses the processor or controller accessing the memory device, exchanging data with the memory device, or storing data to the memory device.

Memory device 204 may store all program code and game code (collectively the "code"), and operation data necessary for the operation of the gaming device 100 and execution of the gaming features described hereinbelow. In an alternative embodiment, game code and operation data necessary for the operation of the gaming device 100 may be store in a distributed manner such that some code is stored in memory device 204 and other code is stored remotely from gaming device 100. In one embodiment, the code and operation data necessary for the operation of the gaming device includes, for example, basic input and output function data, instruction fetching data, bus and network communication protocol data, and like data necessary for an operational gaming device 100. In one embodiment, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in one embodiment, the code and operation data for the operation of the gaming device described above may be stored in removable game cartridges or flash drives, a compact disk ROM, a digital versatile disk (DVD) optical storage technology, or suitable other fixed non-transitory storage mediums. In another embodiment, part or all of the code and operational data for operation of the gaming device or for execution of the game features may be stored in a remote memory structure and be downloaded to the memory device 204 via a network connection.

For a player to interact with gaming device 100, control unit 200 receives and processes player inputs, and control unit 200 causes processed results to be output or communicated to the player. In one embodiment, player inputs are recognized and processed or directed for processing by input/output (I/O) controller 206. Further, I/O controller 206 may process and direct player outputs for communication to the player. I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for each attached input device and output device. In this manner, specially configured processor 202 is freed from the operational details of the peripheral I/O devices. For example, in one embodiment where an input or output device is changed or upgraded, I/O controller 206 can be changed without changing other gaming system 100 components.

In one embodiment, a player deposits value into gaming device 100 by inserting some form of currency into a value acceptor 208 for game play. Alternatively, a player deposits value into gaming device 100 by inserting an encoded paper ticket into a value acceptor 208 for game play in one embodiment. Value acceptor 208 can be combined with a currency reader and validator, and a code reader for reading value encoded on paper tickets. Value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming device 100. During game play, each time a player risks a wager on an outcome, specially configured processor 202 processes the wage and determines the amount of credits to debit from the player's credit balance. When a winning outcome is obtained, specially configured processor 202 is configured to determine the amount of credits to add to the player's credit balance.

As previously mentioned with respect to FIG. 1, a variety of value acceptance arrangements are possible. In one embodiment, the value acceptor 208 could include magnetic strip or chip card readers to accept and transfer value. Value acceptor 208 may also be configured to accept and transfer non-traditional currencies such as digital currencies. In these embodiments, I/O controller 206, a specially configured processor 202, or both contain appropriate control instructions to communicate and extract value from the inserted item containing value. In one embodiment, use of a magnetic strip or embedded chip card, for example a bank card, for value insertion requires specially configured processor 202 to communicate, via network interface controller 224 (described below), with devices external to the gaming device 100.

In one embodiment, card reader 210 may be included in gaming device 100 to accept player loyalty cards. For example, card reader 210 can extract account identifying information from the card and utilizes this information to access the associated account information stored remotely via network interface controller 224. In embodiments where player loyalty/player tracking systems are employed, a player's loyalty account and record of gaming activity can be stored in a networked storage location or database. Specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various embodiments, player control 212 receives a player's game inputs and communicates the player's game inputs to specially configured processor 202. The player's game inputs may include, but are not limited to, wager amounts, pay line selections, game control signals, and cash-out signals. The player control 212 may generate signals based on button presses, touch screen activations, or voice control. The player initiated signals are propagated to the specially configured processor 202 by I/O controller 206. Further, the player initiated signals may direct and inform execution of the game instructions stored in memory device 204 and configured to be executed by specially configured processor 202.

In one embodiment, specially configured processor 202 is configured to execute stored program code and instructions which generate random numbers or pseudo-random numbers. In one embodiment, as illustrated in FIG. 2, a random number generator (RNG) 214 is a software module configured to be executed by specially configured processor 202 for the generation of a true random or pseudo-random number. The code for RNG 214 may be stored in memory device 204. RNG 214 generates random numbers for use by the gaming software during game execution. In one embodiment, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various embodiments, once random symbols are selected based upon the random number generated by RNG 214, patterns of symbols are compared to determine wagering outcomes. In an alternative embodiment, gaming device 100 may include a hardware based random number generator that is in communication with specially configured processor 202 to supply random numbers for game generation purposes. The hardware based random number generator may be incorporated into specially configured processor 202 or can be separate from specially configured processor 202.

In yet another embodiment, random generation of "numbers" or symbols may be performed with electro-mechanical components. For example, gaming devices such as gaming device 100 may incorporate a plurality of mechanical reels rotatable about a common axis. A plurality of indicia or symbols may be positioned around the periphery of the plurality of reels. Each of the indicia or symbols on each reel may indicate separate detectable reel stop positions. The reels can be set into a spinning/rotation motion by pulling a lever or pushing a button. In some embodiments, the gaming device 100 can stop the reels by the gaming device 100 actuating, on a random timing basis, a suitable mechanical or electro-mechanical reel brake. When the reels stop rotating, one or more displayed stop positions of each reel is detected. Since the stop positions are each associated with an indicia or symbol, the gaming device can determine whether the combination of stop positions (i.e., translating to a combination of displayed symbols) results in a winning symbol combination.

Returning to FIG. 2, control unit 200 controls the function and output of a plurality of output devices utilized by gaming device 100. In various embodiments, I/O controller 206 serves as an interface unit between specially configured processor 202 and output devices such as video processor 216, cabinet lighting controller 218, audio controller 220, and value dispenser 222.

In one embodiment, video processor 216 communicates with specially configured processor 202 to render all game graphics, video displays, and information on gaming device 100's one or more video display units. In one embodiment, video processor 216 includes one or more processors, controllers, and/or graphics cards for processing the game images, outcomes, and animated displays and coordinating the processed data to be display between, among, or across any or all display devices. In various embodiments, this may include being configured to simulate objects and the movement of objects which represent video reels containing sets of gaming symbols.

It should be appreciated that in certain other embodiments where physical mechanical reels are utilized by the gaming device 100 as a game displays, reel controllers and stepper motors would be provided in lieu of or in addition to video processor 216.

In embodiments which utilize cabinet lighting as described with respect to FIG. 1, a cabinet lighting controller 218 may be utilized to coordinate and control the color and timing of cabinet lighting displays with specially configured processor 202. In certain embodiments which utilize sound design, specially configured processor 202 may utilize audio controller 220 to coordinate and control the sound emissions. In one embodiment, audio controller 220 may include one or more audio processing cards for generating sound and for driving the one, two or more speakers that may be included with gaming device 100.

In various embodiments, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In one embodiment, value dispenser 222 can be controlled to issue the player's credit value using any of the types of value discussed herein. In some embodiments, the player's credit value may be issued to the player via a printed and dispensed encoded paper ticket or token which the player can then exchange at a special purpose kiosk or cashier location for the monetary value encoded into the ticket or token. In some embodiments, the specially configured processor 202 can direct the value dispenser 222 to issue to the player an appropriate amount of coin or bills directly to the player. Additionally, or alternatively, in some embodiments, the player may have the option to electronically direct the credit value to an account associated with the player.

In some embodiments, control unit 200 of gaming device 100 may communicate with one or more devices outside the gaming device 100. For example, gaming device 100 may be connected to a larger gaming network via a local area network (LAN) or a wide area network (WAN). Control unit 200 may communicate with one or more central servers, controllers, or remote devices to execute games, establish credit balances, participate in jackpots, etc. In such embodiments, network communications and connections are accomplished via a network interface controller 224. Network interface controller 224 can be a digital circuit board or card installed in control unit 200 to provide network communications with external devices.

In some embodiments, various additional features and functions are performed by control unit 200. For example, control unit 200 may be specially configured with appropriate software to track all game play events that occur on gaming device 100. In some embodiments, control unit 200 may audit all recorded monetary transactions, including all wager amounts, game outcomes, game winnings, and game payouts that occur through gaming device 100. Further, some embodiments may include security software to assist in protecting the gaming device 100 from tamper or alteration attempts.

Game Including Symbol Type Conversion

Figure 3A:
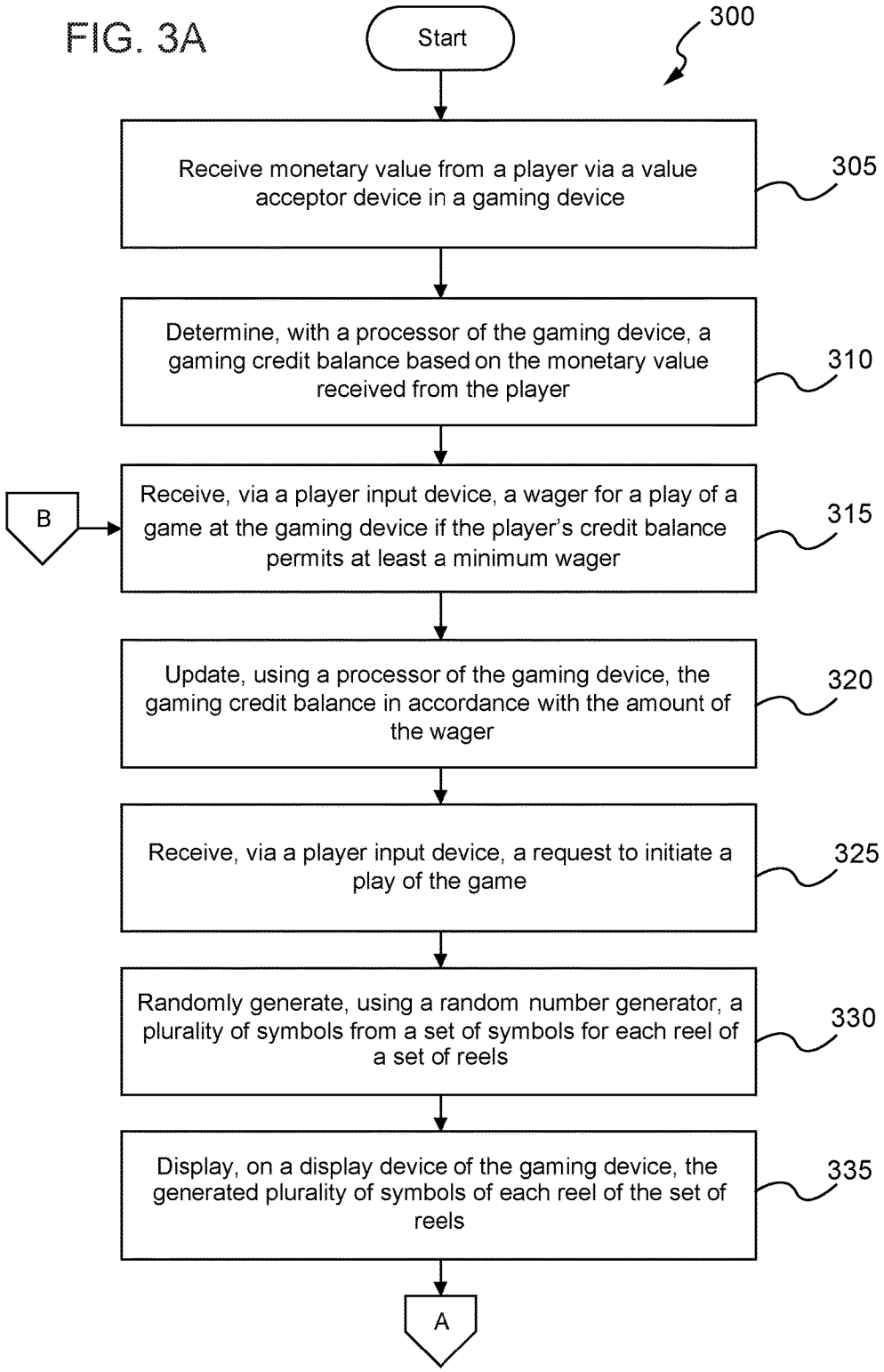
FIGS. 3A and 3B illustrate one embodiment of a method of operating the gaming system.
Figure 3B:
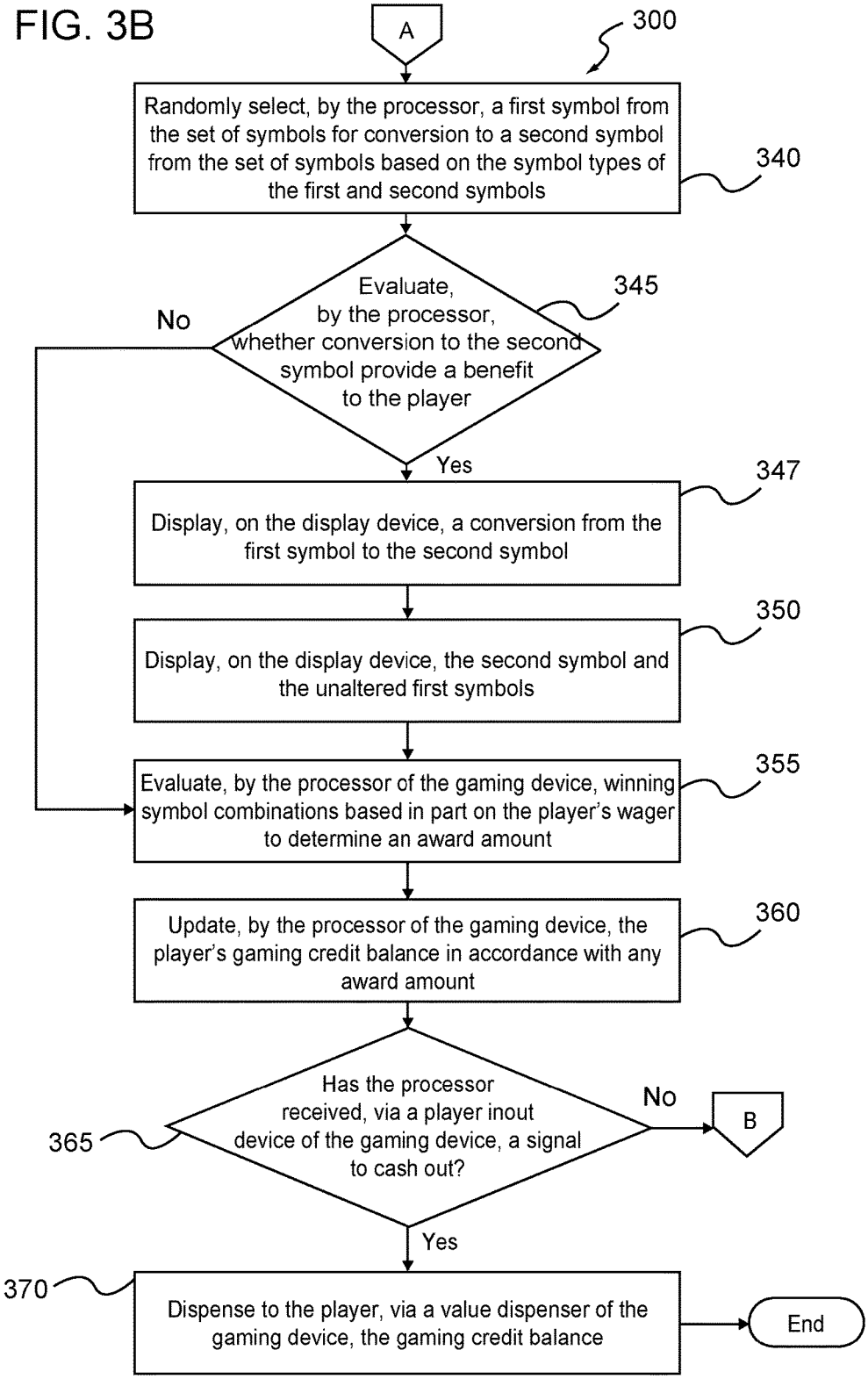

FIGS. 3A and 3B illustrate a flowchart of an example operation 300 of one embodiment of the gaming system and method. In one embodiment, a processor may be configured, via instructions stored in a memory device, to perform the operation 300. However, it should be appreciated that other suitable variations of operation 300 are possible. For example, in one embodiment, fewer or one or more additional blocks (not shown) may be employed in operation 300 of the gaming system and method. In other embodiments, the blocks may be performed in any suitable order.

FIG. 3A illustrates one embodiment in which the gaming system receives a monetary value from a player to initiate operation 300. As indicated in block 305, the gaming system may receive monetary value via a value acceptor device associated with the gaming system. The value acceptor device may be, in one embodiment, disposed in a gaming device or in communication with the gaming device as discussed above.

In one embodiment, the gaming system may determine a credit balance based on the monetary value received from the player at a value acceptor device as indicated in block 310. The gaming system may determine, via a processor, a gaming credit balance for the player. The gaming credit balance may be based on the monetary value received from the player at the value acceptor device.

In one embodiment, the gaming system may receive a wager for a play of a game at the gaming device. Block 315 of FIG. 3A illustrates one embodiment where the player's wager may be received via a player input device. The gaming device may allow a player to place a minimum wager, a maximum wager, or any suitable wager amount. Depending on the wager amount, the gaming device may also enable the player to select pay lines across displayed symbol positions on reels in a game. In one embodiment, the gaming system may determine whether the player provided enough credits to enable the player's selected wager. The gaming system may prevent the player from placing the wager and starting a play of a game if the player's credit balance is not large enough to support the player's selected wager. If enough credits are not available in the player's credit balance, the gaming system enables the player to insert additional value to obtain the minimum credit level or to cash out of the gaming device.

In one embodiment, the gaming system may use a processor of the gaming device to update a gaming credit balance. The credit balance may be updated in accordance with the player's wager amount as indicated in block 320. Some embodiments, the credit balance is not updated until a later time.

Block 325 illustrates one embodiment in which the gaming system may receive a request to initiate a play of a game. The request to initiate the play of the game may be received from a player via a player input device. For example, the player may press a spin button on the gaming device to start spinning reels for the play of the game.

In one embodiment, the gaming system may use a random number generator to randomly generate a plurality of symbols from a set of symbols as indicated in block 330. In one embodiment, at least some of the symbols in the set of symbols are classified or associated with a symbol type. In some embodiments, the gaming system may generate the plurality of symbols for display on a set of reels. As used herein, the random number generation may refer to pseudo-random or true-random number generation depending on the module used for the random number generation.

In one embodiment, the gaming system may cause a display device to display the plurality of symbols generated as indicated in block 335. In a game using reels, the gaming system may display the generated plurality of symbols in symbol display areas of each of the reels.

Turning now to FIG. 3B and block 340, in one embodiment, the gaming system randomly selects, by the processor, a first symbol from the set of symbols. The selected first symbol is associated with a first symbol type. The gaming system may convert selected first symbol to a second symbol different from the first symbol when the selected first symbol is generated for a play of the game. The second symbol may be associated with a second symbol type. The symbol conversion may be based on the symbol types of the first symbol and the second symbol, where the symbol types are different. The gaming system may use a mapping between symbols in the set of symbols to determine which symbol in the set of symbols should be used for the second symbol.

As illustrated in block 345, in one embodiment the processor evaluates, according to at least one symbol type conversion mapping, whether the player will benefit from a conversion of the first symbol into the second symbol. In one embodiment, the gaming system performs the symbol conversion when the symbol conversion benefits the player. In one embodiment, a benefit to the player is an award that is greater than the award the player would have received without the symbol conversion. In another embodiment, a benefit to the player is any award that would not exist prior to symbol conversion. In one embodiment, a conversion from a first symbol to a second symbol having an equal or greater pay value may benefit a player. In one embodiment, a second symbol which creates a symbol combination of equal or greater pay line value may benefit the player. It should be appreciated that other benefit evaluations are possible. In some embodiments, the gaming system may perform the symbol type conversion even if the symbol type conversion did not improve the player's award from the award the player would have received without the symbol conversion. In some such embodiments, gaming system may perform the symbol type conversion even if the conversion reduced the player's award from the award the player would have received without the symbol type conversion. It should be appreciated that, the term symbol type conversion and symbol conversion are used interchangeably herein.

If the result of the evaluation conducted in block 345 indicates no benefit to the player, the gaming system may determine the symbol type conversion analysis is complete and the gaming system moves to block 355. The gaming system may evaluate the generated symbols for winning symbol combinations based upon the symbol combinations displayed without the symbol type conversion. It should be appreciated that moving to block 355 enables the gaming system to reduce processing computations and power by eliminating needless screen displays of symbol type conversions that do not produce a player benefit. In this manner, the time to perform award calculations is reduced for the play of the game and delay in concluding the play of the game is reduced (where the player received no additional benefit from the symbol type conversion). This increased efficiency in the game also permits players to play more games. On the other hand, when the gaming system displays a symbol type conversion, player anticipation of the symbol type conversion is greatly enhanced.

If the processor determines in block 345 that a player will benefit from the symbol type conversion from the first symbol to the second symbol, operation 300 proceeds to block 347. A detailed description of one embodiment of a symbol type conversion, including symbol mapping, is provided in relation to FIGS. 3B and 3C hereinbelow.

In one embodiment, at block 347, the gaming system displays on the display device a conversion from the first symbol to the second symbol. In one embodiment, the gaming system generates the second symbol to replace the first symbol based on a mapping between the first symbol and the second symbol. In an embodiment without reels, the gaming system may replace the first symbol with the second symbol in any suitable manner. In an embodiment with reels, the gaming system may provide a re-spin of at least one reel that displays the first symbol. In some embodiments, the gaming system may re-spin all the reels that display the first symbol. When the gaming system stops the spinning reels, the first symbol is replaced on the reels subject to the re-spin. Symbols not selected for conversion that appeared on reels subject to a re-spin continue to appear on the reel after the re-spin display. It should be appreciated that replacing the first symbol with the second symbol on a reel may be accomplished with dynamic symbol mapping on the reels in some embodiments. It should also be appreciated that other symbol conversion displays are possible.

In one embodiment, the gaming system may display on a display device, the second symbol and the unaltered symbols as indicated in block 350.

The gaming system may evaluate, in one embodiment, the displayed symbols for winning symbol combinations in block 355 to determine the player's award. In some embodiments, gaming system evaluates the winning symbol combinations based on the pay lines wagered upon by a player as indicated in block 355. The game system may evaluate the player selected pay lines or default pay lines. In one embodiment using reels, the gaming system determines an award amount based on winning symbol combinations formed across the reels on active (wagered upon) pay lines.

Block 360 illustrates one embodiment in which the gaming system may update, by a processor of the gaming device, the gaming credit balance in accordance with any award amount determined in block 355.

In one embodiment, as indicated in block 365, the gaming system may receive a signal to end game play or "cash out"

via an input device of the gaming system. The gaming system dispenses a value to the player, through a value dispenser, based on the gaming credit balance. In one embodiment, if the processor has not received a signal to end game play via the player input device, the process of operation 300 returns to block 315. The gaming system may receive, via a player input device, a wager for another play of the game. However, in one embodiment, the wager may not be accepted if the player has fewer credits than the player's selected wager amount.

Figure 3C:
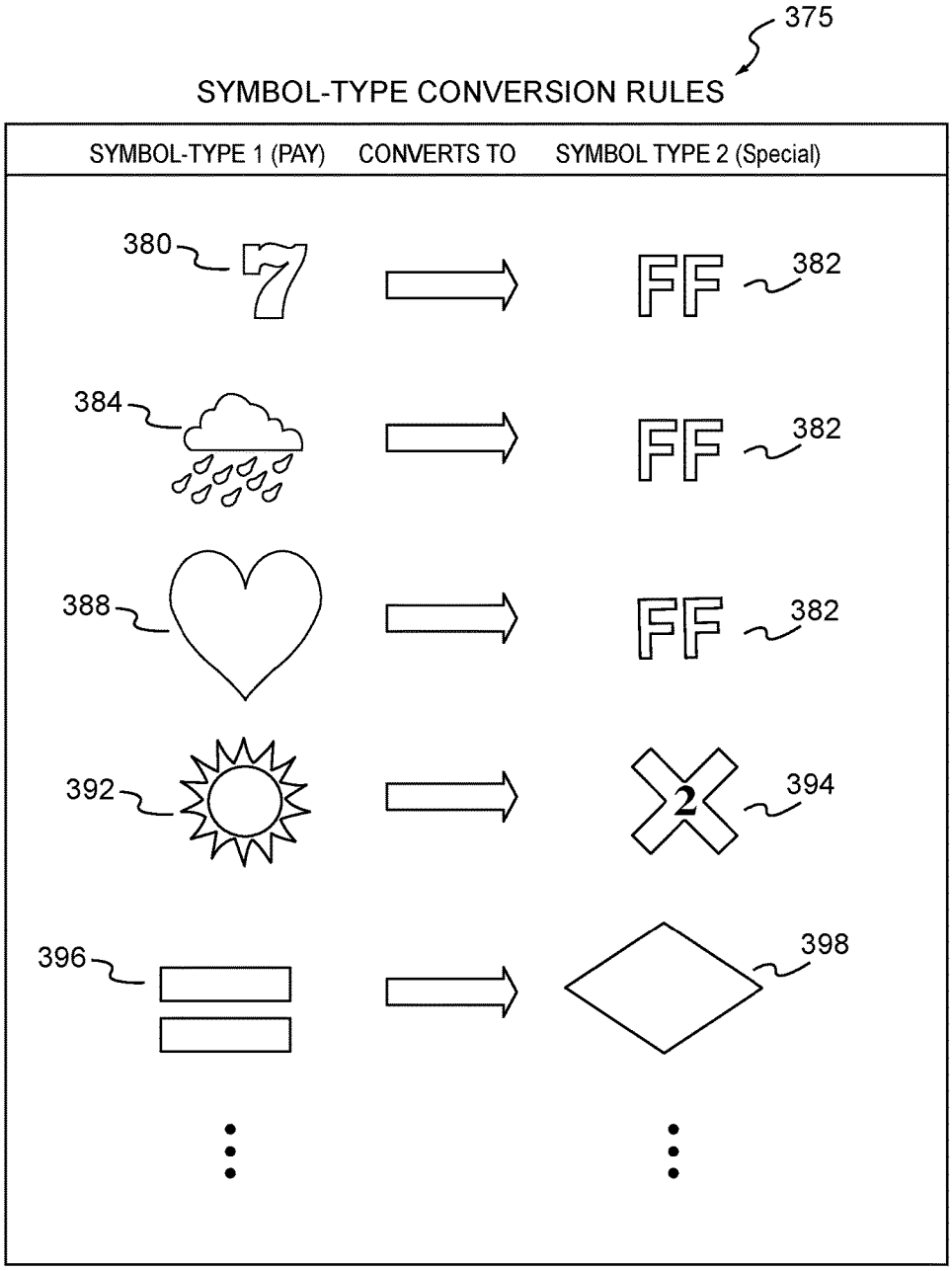
FIG. 3C illustrates a visual representation of one embodiment of symbol type conversion mapping.

FIG. 3C illustrates a visual representation of one embodiment of a symbol conversion mapping that illustrates a plurality of first symbols having a first symbol type and each of their mappings to a second symbol having a second symbol type. Symbol type conversion maps may be predetermined and may be varied by game designers based upon the game set of symbols utilized, the game symbol types utilized, the gaming system deployment location, the amount of wager, and the like. Symbol type conversion maps may be randomly generated. The symbol type conversion maps maybe created at any suitable time before or during a play of a game. In one embodiment, a gaming system may have more than one symbol type conversion map. For example, different symbol type conversion mappings could be applied to one or more individual reels across a gaming system's reel set. In one embodiment, the mappings between symbols is not contained in a map. In other embodiments, the mapping between symbols is not predetermined. For example, the gaming system may generate a mapping between two symbols when a symbol is selected for conversion.

A set of symbols for a play of a game may include a plurality of symbols. The symbols may include numbers, letters, geometric figures, symbols, images, character, blank symbols (e.g., the absence of symbols), animations, or any other suitable graphical depiction. Each symbol may be associated with a function, or symbol type. For example, a gaming system may utilize a set of symbols for generating game outcomes that may comprise fifteen symbols in one embodiment. Each symbol in the set of symbols may have an associated symbol type such as a pay symbol type, or a special symbol type. In one embodiment, symbol types are descriptive of a game symbol's function in the game. It should be appreciated that other symbol types are possible.

In one embodiment, a pay symbol type is associated with a symbol that functions, in combination with other symbols, to form winning symbol combinations along pay lines, which provide awards to a player. In one embodiment, each symbol associated with the pay symbol type may be referred to as a pay symbol.

Pay symbols may have an associated value, and the gaming system may display a pay symbol's associated value in a pay table (not shown). The pay table displays each pay symbol combination that generates a game award, and the amount of the generated award. For example, in a gaming system with five reels, the pay table may indicate a display of three adjacent cherry symbols along a pay line results in an award of one credit. Similarly, when the gaming system displays four adjacent cherry symbols along a pay line, the result is an award of five credits. Likewise, when the gaming system displays five adjacent cherry symbols along a pay line, the result is an award of 40 credits. This same example pay table may also indicate that the pay line display of three double-bar symbols generates an award of 10 credits, the pay line display of four double-bar symbols generates an award of 20 credits, and the pay line display of five double-bar symbols across five reels may generate an award of 400 credits. In this manner, the pay table may indicate a value hierarchy between pay symbols.

In one embodiment, a special symbol type is associated with a symbol that functions, alone or in combination with other symbols, to provide or trigger special game functions. The symbols associated with the special symbol type may be referred to as special symbols. Special symbols may trigger the gaming system to perform a special function when such special symbols are generated in a play of a game. A plurality of special symbols may be provided in the set of symbols.

For example, the set of symbols for the gaming system may include a wild symbol (a type of special symbol). A wild symbol may functionally mimic or substitute for the characteristics of another game symbol. In one embodiment, the set of symbols for the gaming system may include a Flipside Frenzy symbol "FF" illustrated as symbol 382 in FIG. 3C. The Flipside Frenzy symbol is a special symbol that can mimic or substitute for any of the other plurality of symbols associated with the set of symbols and have additional functions in the game. That is, the appearance of a Flipside Frenzy symbol on a stopped reel may cause the gaming system to evaluate the Flipside Frenzy symbol like one of the other symbols along a wagered pay line for purposes of determining a winning symbol combination. In another embodiment, gaming system may cause the Flipside Frenzy symbol to flip or turn a predetermined number of degrees (e.g., approximately 180 degrees or other suitable number of degrees) to reveal a different symbol. In such an embodiment, the different symbol may cause the gaming system to change certain other visible symbols around the different symbol into the different symbol. In another embodiment, gaming system may cause other visible symbols on a reel displaying the Flipside Frenzy symbol to change into the Flipside Frenzy symbol. In some embodiments, the gaming system does not execute any functions associated with the Flipside Frenzy symbol unless another predetermined symbol is visibly displayed. As can be appreciated, the Flipside Frenzy symbol is a special symbol that includes more functions than simply substituting for other symbols in a game. It should also be appreciated that a Flipside-Frenzy symbol may be used in addition to wild symbols, where the wild symbols may be limited to a substitution function in the game.

In one embodiment, a special symbol in the set of symbols may include a multiplier symbol. The appearance of a multiplier symbol may cause the gaming system to perform a payout multiplier on any winnings from the game. The "2×" symbol, illustrated as symbol 394 in FIG. 3C is one example of a multiplier symbol. In one embodiment, when a multiplier symbol appears along an award generating (winning) pay line, the award amount is multiplied by the number of times indicated by the symbol. In the case of a 2× multiplier symbol appearance on a winning pay line, the award amount may be doubled. In the case of a 3× multiplier symbol appearance on a winning pay line, the award amount may be tripled.

In one embodiment, a special symbol in the set of symbols may include a bonus symbol. A bonus symbol (not shown) is a symbol that may cause the gaming system to execute a bonus game during or after a play of a game. In another example, a bonus symbol may trigger free spins or may cause the gaming system to execute a predetermined number of free spins. Depending on the design of a specific game, the bonus symbol may trigger the gaming system to execute a bonus function when one or more bonus symbols appears on the reels.

In one embodiment, a special symbol of the set of symbols may include a scatter symbol. A diamond scatter symbol 398 is shown FIG. 3C. A scatter symbol may cause the gaming system to provide an award when a predetermined number of scatter symbols are generated for a play of a game. In other words, scatter symbols may fall randomly across the reels and not be aligned in any formation to trigger a player award. In one embodiment, the appearance of one scatter symbol on a reel may trigger a small award, and the appearance of two or more scatter symbols on the reels may trigger a larger award. Other variations are possible consistent with the scatter symbol principal.

Returning to FIG. 3C, a partial table illustrates mappings between symbols of the set of symbols, where one symbol is mapped to another symbol, and the mapped symbols have different symbol types. In one embodiment, each of the symbols in the set of symbols is mapped to another symbol from the set of symbols (not shown). In other embodiments, a subset of the symbols from the set of symbols is mapped to other symbols. For a play of a game, as illustrated in block 340 of FIG. 3B, a gaming system processor may select a first symbol from a set of symbols having a first symbol type. For example, the gaming system may randomly select a symbol from the set of pay symbols, shown in the left column of FIG. 3C. In one embodiment, the gaming system may select a first symbol before, during, or after the gaming system randomly generates a plurality of symbols for the play of the game.

The gaming system processor may generate or may reference a symbol type mapping, such as the visual representation illustrated in FIG. 3C, to determine the second symbol and second symbol type associated with the selected first symbol for conversion. In one embodiment, FIG. 3C illustrates the following pay symbol conversion mappings: a seven symbol 380 converts to a Flipside Frenzy symbol 382; a storm symbol 384 converts to a Flipside Frenzy symbol 382; a heart symbol 388 converts to a Flipside Frenzy symbol 382, a sunshine symbol 392 converts to a 2× multiplier symbol 394; and a double-bar symbol 396 converts to a diamond symbol 398. For purposes of brevity, only a representative selection of symbol type conversion mappings are shown and described herein. It is to be understood that many symbol type conversion mappings are possible. Further, as previously noted, symbol type conversion maps may be predetermined and may be varied by game designers based upon the game symbol set utilized, the gaming system deployment location, the amount of wager, and various other constraints. In one embodiment, a gaming system may have more than one symbol type conversion maps. For example, different symbol type conversion maps could be applied to one or more individual reels across a gaming system's reel set.

It is also noted that, for purposes of brevity, the symbol type conversion maps in FIG. 3C illustrate pay symbol to special symbol conversions. In one embodiment, mappings between the same symbol types can be used (e.g., a pay symbol to another pay symbol conversion). In one embodiment, the gaming system may use a pay symbol to pay symbol conversion with the condition that the symbol conversion proceeds when the second symbol has an equal or an associated value greater than the first symbol. The gaming system may use other conditions to determine whether to perform a symbol conversion based upon benefits of the symbol conversion benefit to a player. In one example embodiment, the player may not be penalized by a symbol type conversion (with lower awards from the symbol conversion). However, in other embodiments, the gaming system may perform a symbol conversion even if the symbol conversion penalizes the player.

As can be appreciated from the mapping illustrated in FIG. 3C, symbol types may be converted. As illustrated in FIG. 3C, pay symbols are converted to special symbols. The special symbols may include, for example, Flipside Frenzy symbols, wild symbols, multiplier symbols, or scatter symbols. Other symbols and symbol types may be possible. In one embodiment, each symbol in the set of symbols can be mapped to another symbol in the set of symbols. Additionally, in one embodiment, any suitable subset of the symbols from the set of symbols may be mapped to another symbol from the set of symbols. In one embodiment, the mapping of symbols from the set of symbols can be to symbols from a different set of symbols.

It should be appreciated that the gaming system may determine a second symbol for conversion based on mappings between symbols. The gaming system may also evaluate the symbol conversion benefit to a player. In one embodiment, the processor may evaluate generated symbols for winning symbol combinations prior to performing a symbol conversion. The gaming system may compare an award for wining symbol combinations prior to a symbol conversion to an award for winning symbol combinations created after the symbol conversion. In one embodiment, symbol type conversion may proceed when the gaming system processor determines that a symbol type conversion benefits a player.

Figure 4A:
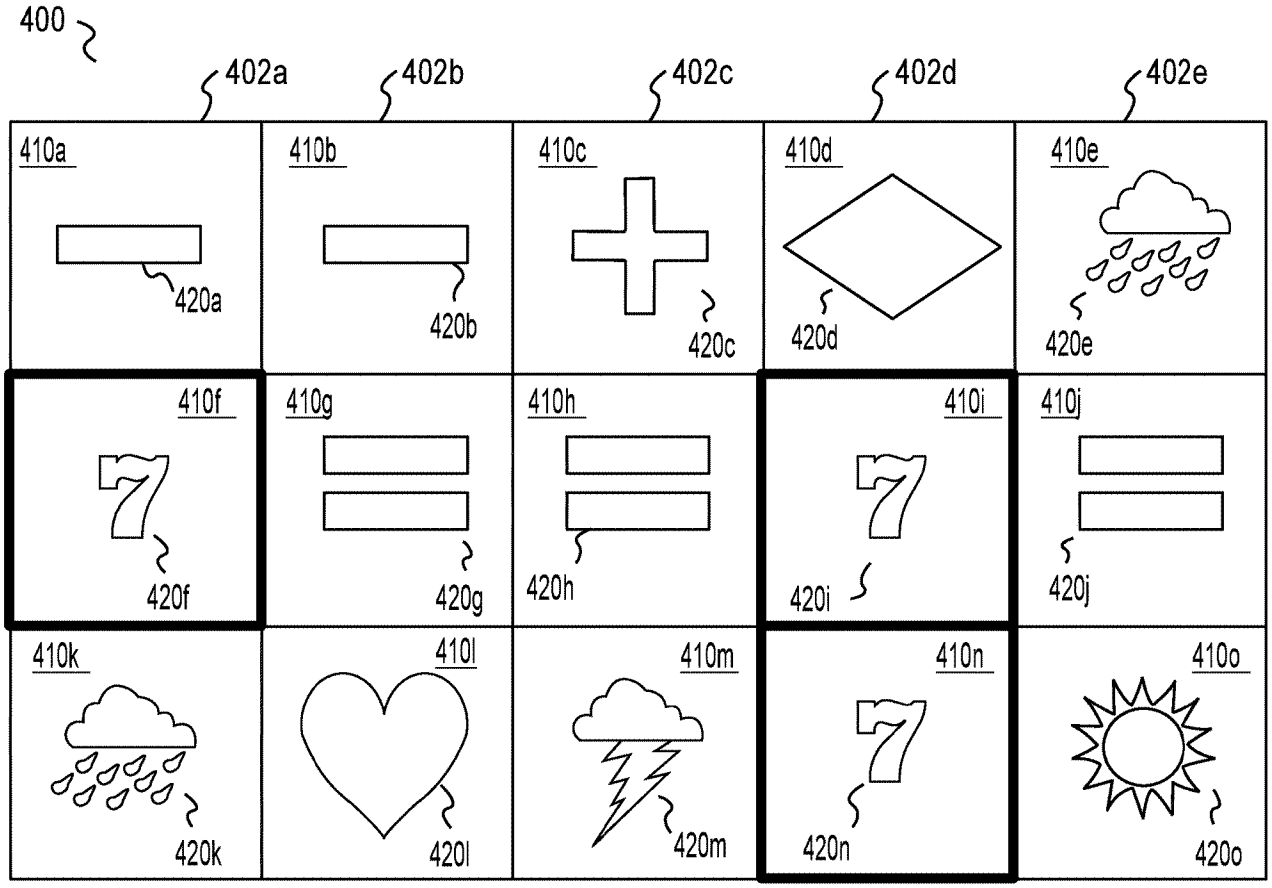
FIGS. 4A, 4B, and 4C illustrate screen shots of one embodiment of a gaming system having symbol type conversion.
Figure 4B:
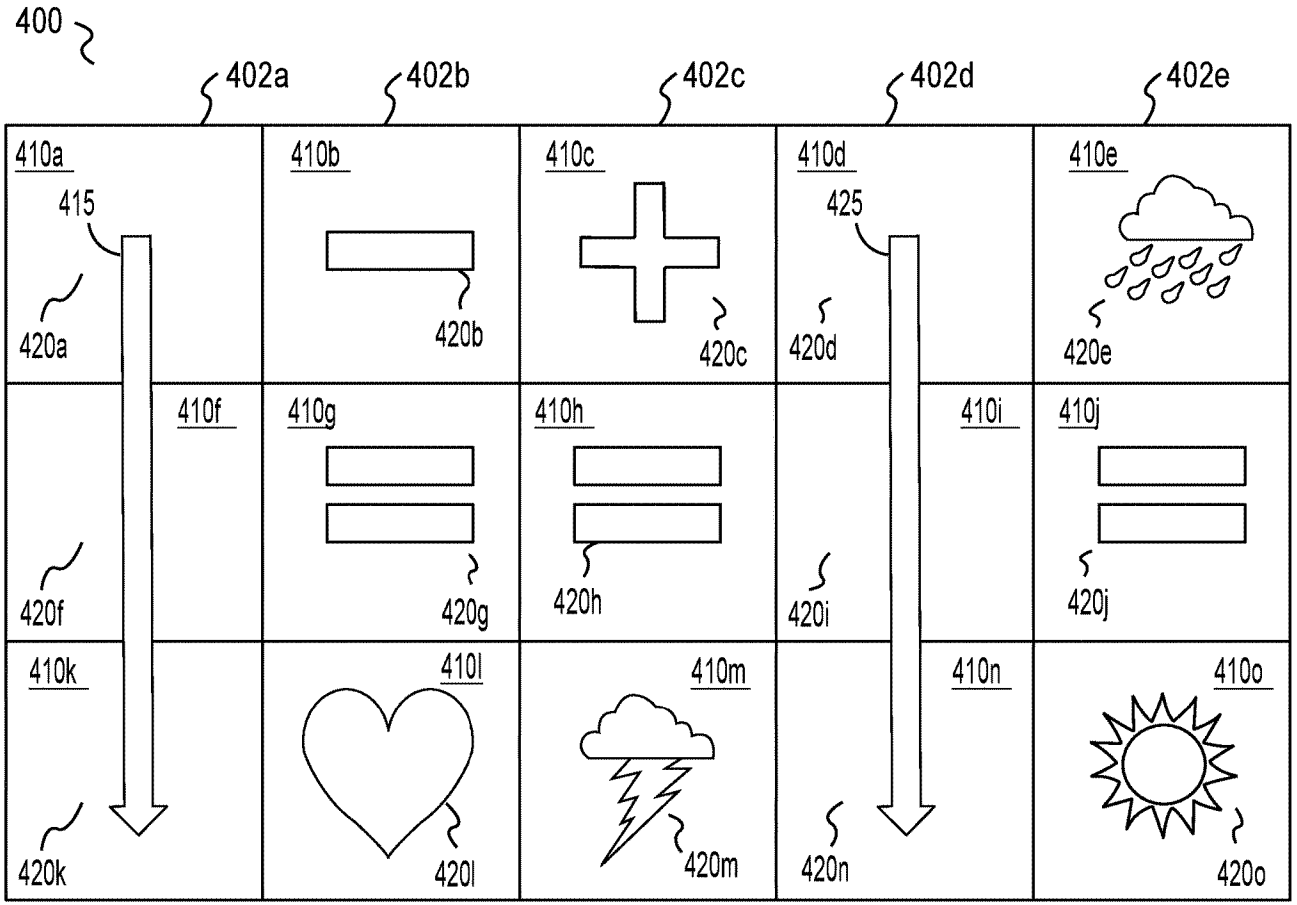
Figure 4C:
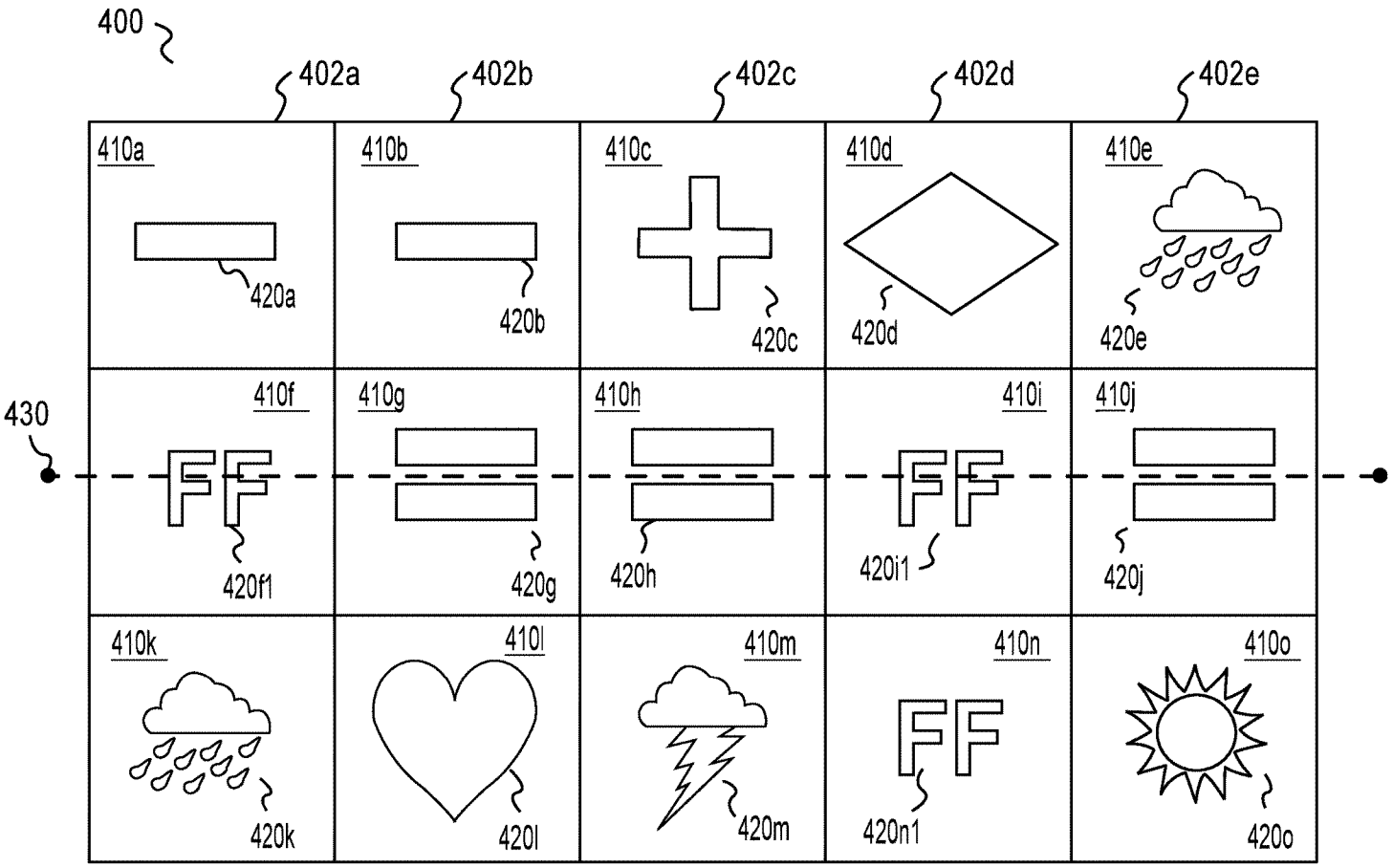

FIGS. 4A, 4B, and 4C, illustrate screen shots of one embodiment of a gaming system having a symbol type conversion game.

FIG. 4A illustrates one embodiment of a game display 400 that the gaming device 100 may display on a display device. In one embodiment, game display 400 may be displayed on first display 122 of gaming device 100 illustrated in FIG. 1. However, any other suitable display may be used. The game display 400 displays a set of a plurality of reels 402*a*, 402*b*, 402*c*, 402*d*, and 402*e* as illustrated in FIG. 4A. As also illustrated in FIG. 4A, the reels 402*a*-402*e* are displayed substantially side by side. It should be appreciated that reels 402*a*-402*e* can be displayed with any suitable amount of separation or no separation. It should be appreciated that the game shown in game display 400 is merely representative and may have more or fewer game elements shown in the game display 400.

The plurality of reels 402*a*-402*e* are each associated with a set of symbols, where the set of symbols includes a plurality of symbols. Each reel 402*a*-402*e* is associated with a plurality of symbols of the set of symbols. Each reel 402*a*-402*e* can also be associated with the same or a different plurality of symbol combinations from the first set of symbols. The set of symbols may include numbers, letters, geometric figures, symbols, images, character, blank symbols (e.g., the absence of symbols), animations, or any other suitable graphical depiction. The symbols in the set of symbols may include pay symbols and special symbols.

Returning now to FIG. 4A, the game display 400 depicts a plurality of symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, and 410*o*. This plurality of symbol display areas can be associated in a manner that provides the appearance of game reels. It should also be appreciated that the symbol display areas may not be associated with game reels in some embodiments. As illustrated in FIG. 4A, symbol display areas 410*a*, 410*b*, 410*c*, 410*d*, 410*e*, 410*f*, 410*g*, 410*h*, 410*i*, 410*j*, 410*k*, 410*l*, 410*m*, 410*n*, 410*o* are associated in a manner that provides the appearance of a set of five game reels. In one embodiment, the plurality of symbol display areas that provide the appearance of five game reels may be arranged in a manner that visibly shows three symbol positions of each of the five game reels. For example, the symbol display areas 410*a*-401*o* are each associated with positions on reels 402*a*-402*e*, respectively. As shown in FIG. 4A, symbol display areas 410*a*, 410*f*, and 410*k* are associated with reel 402*a*; symbol display areas 410*b*, 410*g*, and 410*l* are associated with reel 402*b*; symbol display areas 410*c*, 410*h*, and 410*m* are associated with reel 402*c*; and symbol display areas 410*d*, 410*i*, and 410*n* are associated with reel 402*d*; and symbol display areas 410*e*, 410*j*, and 420*o* are associated with reel 402*e*. The arrangement illustrated in the embodiment of FIG. 4A thus creates a visible display area of the reels 402*a*-402*e* comprising three visible symbol positions for each reel. When viewed together, reels 402*a*-402*e* appear like a 3-row by 5-column reel array in display 400. In other embodiments, smaller or larger visible areas of the reels can be displayed. That is, the reels 402*a*-402*e* may show fewer or a larger number of visible symbol display areas. While symbol display areas are illustrated with defined boxes, it should be appreciated that in some embodiments, the defined boxes are not visible to the player.

Each reel 402*a*-402*e* may display a plurality of symbols from the set of symbols in their respective symbol display areas as illustrated in FIG. 4A.

To start a gaming session, a player provides the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game and to also place wagers on a play of the game. The gaming system may provide a visual indication of the player's credit balance to the player as discussed above.

To initiate a play of a game, the player presses one or more appropriate buttons on the gaming system to deduct credits necessary to play the game and to identify the player's wager. Along with receiving the player's wager, the gaming system may receive pay line selections or other game functions the player wishes to activate in exchange for the wager. The player may also actuate a game start button or a spin button. The gaming system may deduct the appropriate credits from the player's credit balance after the wager or at any suitable time.

Upon receipt of the player's wager and activation of the game start button, the gaming system may show a display of spinning reels for each of the reels 402*a*-402*e*. The spinning may appear to occur in a vertical top to bottom direction or in a vertical bottom to top direction, or in a combination of vertical directions. In one embodiment, the gaming system randomly generates symbols 420*a*-420*o* from the first set of symbols for reels 402*a*-402*e*, respectively. As noted above, the gaming system may rely on random generation performed by a pseudo RNG, a true RNG, or hardware RNG.

The gaming system displays the generated symbols 420*a*-420*o* in symbol display areas 410*a*-401*o* as illustrated in FIG. 4A. Symbols 420*a*-420*o* displayed on reels 402*a*-402*e* illustrate the randomly generated symbols after the reels have stopped spinning. As illustrated in FIG. 4A, the gaming system randomly generated and displayed symbols 420*a*, 420*f*, and 420*k* in symbol display areas 410*a*, 410*f*, and 410*k* for reel 402*a*. The gaming system also randomly generated and displayed symbols 420*b*, 420*g*, and 420*l* in symbol display areas 410*b*, 410*g*, and 410*l* for reel 402*b*; symbols 420*c*, 420*h*, and 420*m* in symbol display areas 410*c*, 410*h*, and 410*m* for reel 402*c*; symbols 420*d*, 420*i*, and 420*n* in symbol display area 410*d*, 410*i*, and 410*n* for reel 402*d*; symbols 420*e*, 420*j*, and 420*o* in symbol display area 410*e*, 410*j*, and 410*o* for reel 402*e*.

As illustrated in FIG. 4A, the gaming system generated and displayed single bar symbols (420*a*, 420*b*), cross symbol (420*c*), diamond symbol (420*d*), storm symbols (420*e*, 420*k*), seven symbols (420*f*, 420*i*, 420*n*), double bar symbols (420*g*, 420*h*, 420*j*), heart symbol (420*l*), lightening symbol (420*m*), and sunshine symbol (420*o*) in the game display 400. All displayed symbols are associated with at least one symbol type. In this embodiment, fourteen pay symbols and one special symbol (diamond) are shown. However, is should be appreciated that the displayed symbol combinations are merely for explanatory purposes and the gaming system may randomly generate any suitable combination of symbols based on defined symbol sets. In some embodiments, the gaming system may generate and display all symbols associated with the same symbol types.

FIG. 4A illustrates one embodiment of the gaming system performing an evaluation of the generated symbols on reels 402*a*-402*e* and executing game functions to convert certain displayed symbols based upon symbol type conversion mappings. The gaming system may randomly select at least one symbol from the generated symbols 420*a*-420*o* for a symbol conversion. In one embodiment, the gaming system may randomly select at least one symbol from the set of symbols. The gaming system may perform the random selection using the RNGs as discussed above. If the selected symbol is not generated or displayed in at least one of positions 420*a*-420*o*, the gaming system may end the symbol type conversion processing. In one embodiment, the gaming system randomly selects the at least one symbol for the symbol type conversion before the play of the game. In an alternative embodiment, the gaming system randomly selects the at least one symbol during the play of the game. In one such embodiment, the gaming system selects the at least one symbol during the play of the game, but before the gaming system generates the symbols on reels 402*a*-402*e*. In one alternative embodiment, the gaming system selects the at least one symbol during the play of the game, but after the gaming system generates the symbols on reels 402*a*-402*e*. It should be appreciated that the selection for the symbol conversion can occur at any suitable time.

Returning now to FIG. 4A, the gaming system randomly selected the seven symbol for a symbol type conversion, as indicated by the highlighted border around symbol display areas 420*f*, 420*i*, and 420*h*. It should be appreciated that the gaming system may not highlight the border in some embodiments. However, in some embodiments, any symbol selected for conversion may be highlighted to the player prior to conversion display. It should also be appreciated that the gaming system may illustrate to the player that the seven symbol was selected in any suitable manner.

In one embodiment, the gaming system processor refers to a stored symbol type conversion mapping (e.g., in memory) for the seven symbol, as illustrated in FIG. 3C. Referring to FIG. 3C, the seven symbol 380 is a pay symbol. When the seven symbol is selected for conversion, the gaming system converts the seven symbol to an FF symbol 382, which is a special symbol. In one embodiment, the gaming system may perform a player-benefit analysis for the selected symbol's conversion. In the example illustrated in FIGS. 3C and 4A, the gaming system determines that the initial randomly generated symbols fail to result in any winning symbol combinations, which results in no player awards. However, when the seven symbol is converted to an FF symbol according to the symbol type conversion for the play of the game, the gaming system determines that a winning symbol combination is possible along at least one a pay line. Thus, the gaming system determines that the player benefits from the symbol conversion and the gaming system processor may perform the symbol type conversion.

In the embodiment illustrated in FIG. 4B, the gaming system causes a symbol type conversion display to appear for each reel containing the symbol selected for conversion. In one embodiment, a spinning reel display may be shown for the reels 402*a* and 402*d* as indicated by arrows 415 and 425 of FIG. 4B. The gaming system may re-spin reels 402*a* and 402*d* because these reels contained the seven symbol and the seven symbol was selected for conversion to the FF symbol. The reel re-spin display may generate great player excitement and anticipation while the seven symbol 380 is converted into an FF symbol. It should be appreciated that a symbol conversion may be provided in a variety of other ways. In one embodiment, the gaming system may display a reel re-spin where symbols that are not converted reappear in the same symbol display areas of the re-spun reel while the selected symbol is replaced with the new symbol. This can be accomplished using dynamic reel remapping. In one embodiment, the symbols selected for conversion may animate or morph into the conversion symbols without performing any change or animation to the other, non-selected symbols on a reel. Any other suitable symbol type conversion displays are possible.

FIG. 4C illustrates one embodiment of a gaming system executing an evaluation of the symbol combinations for winning symbol combinations after a symbol type conversion. As noted above, the player may have wagered on one or more pay lines. In one embodiment, at least the wagered on pay lines are evaluated for winning symbol combinations. Any suitable number of pay lines may be used to evaluate winning symbol combinations. While FIG. 4C shows a single horizontal pay line for evaluation, other figures in the disclosure illustrate some of the many alternative pay line evaluations that are possible.

In the embodiment illustrated in FIG. 4C, the gaming system evaluated the displayed symbol combinations for any winning symbol combinations. In FIG. 4C, the gaming system determined a winning symbol combination is displayed across one wagered pay line 430. The pay line spans across a horizontal direction of symbol display positions including symbol display positions 410*f*, 410*g*, 410*h*, 410*i*, and 410*j*. In this embodiment, a display of five double bar symbols along a horizontal pay line results in a winning symbol combination. While only three double bar symbols 420*g*, 420*h*, and 420*j* are displayed on the second row of reels 402*a*-402*e*, the FF symbols take on the characteristics of the double bar symbols in positions 410*g*, 410*j* and 410*j*. Thus, the gaming system evaluates symbols 420*f*1, 420*g*, 420*h*, 420*i*1, and 420*j* as double bar symbols for purposes of the gaming system determining winning symbol combinations.

The winning pay line is illustrated as pay line 430 in FIG. 4C across the winning row of reels 402*a*-402*e*. Based on the winning symbol combination along the pay line 430, the gaming system awards the appropriate number of credits to the player and updates the player's credit meter to reflect the winnings. The gaming system may display the number of winning credits and may display the player's total credit balance in a display of the gaming system.

The player may continue the gaming session by playing another game. That is, the player may place a wager and start a new play of the game as noted above. However, continued game play is dependent of the number of credits the player has in the player's credit balance. The player may also choose the cash out. In such an instance, the gaming system provides the player a value based on the player's credit balance using any of the value items discussed above (bills, coins, vouchers, etc.)

It should be noted that prior to the symbol type conversion of the seven symbols 420*f*, 420*i*, and 420*h* (i.e., pay symbols) to the Flipside Frenzy symbols 420*f*1, 420*i*1, and 420*h*1 (i.e., special symbols), no symbol combinations were present on any pay lines that would have formed a winning symbol combination from the initially generated symbols on reels 402*a*-402*e* (as illustrated in FIG. 4A). However, the game resulted in a winning symbol combination for the player due to the gaming system processor's random selection of the seven symbol for symbol type conversion, mapping the seven symbol to the FF symbol, and the gaming system processor's evaluation that the symbol type conversion would provide a benefit to the player via payment of a larger award. It should be appreciated that in some embodiments, the gaming system may not perform any player benefit analysis before performing the symbol type conversion.

Figure 5A:
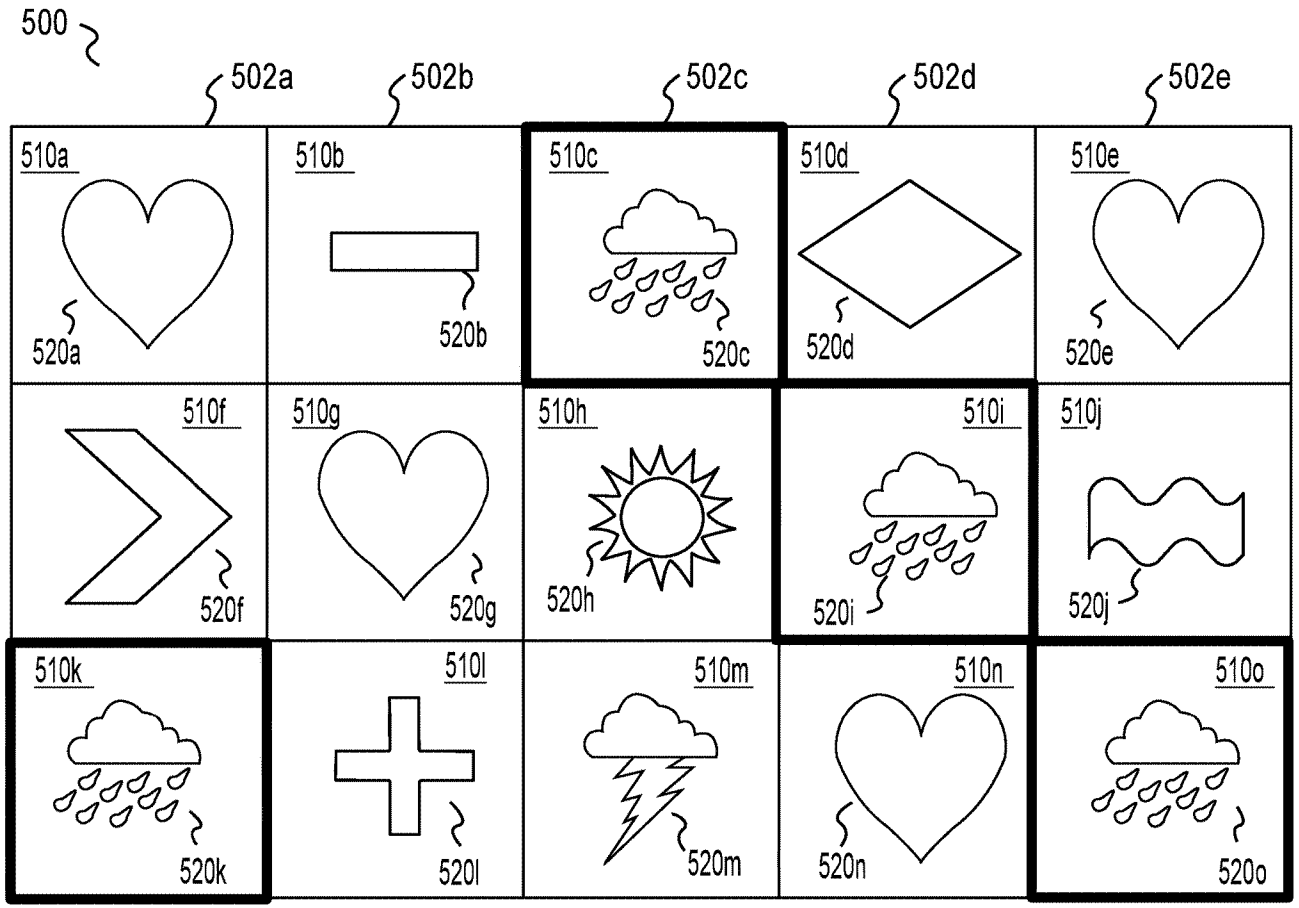
FIGS. 5A, 5B, and 5C illustrate screen shots of one embodiment of a gaming system having a different symbol type conversion display from the display indicated in FIGS. 4A-4C.
Figure 5B:
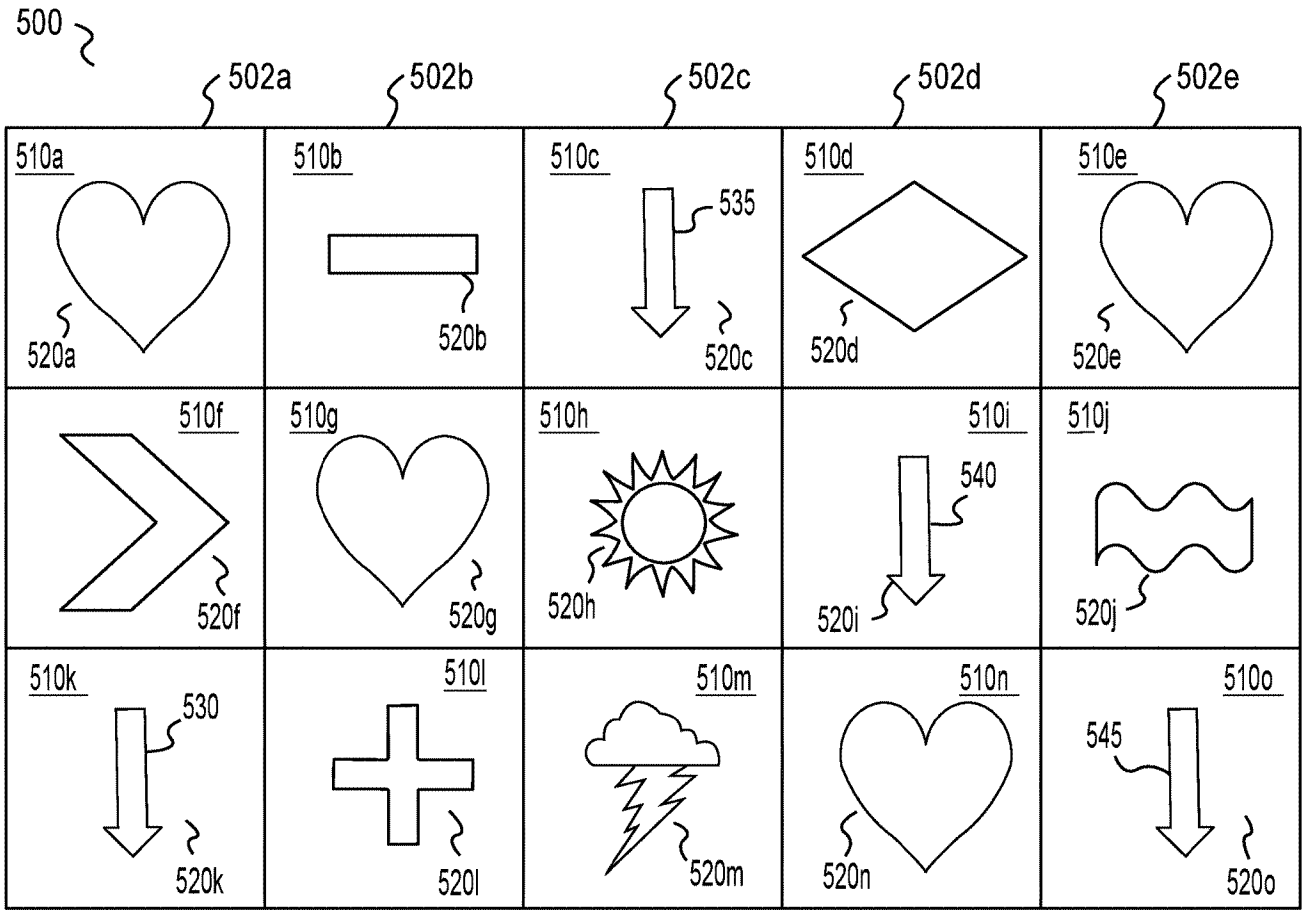
Figure 5C:
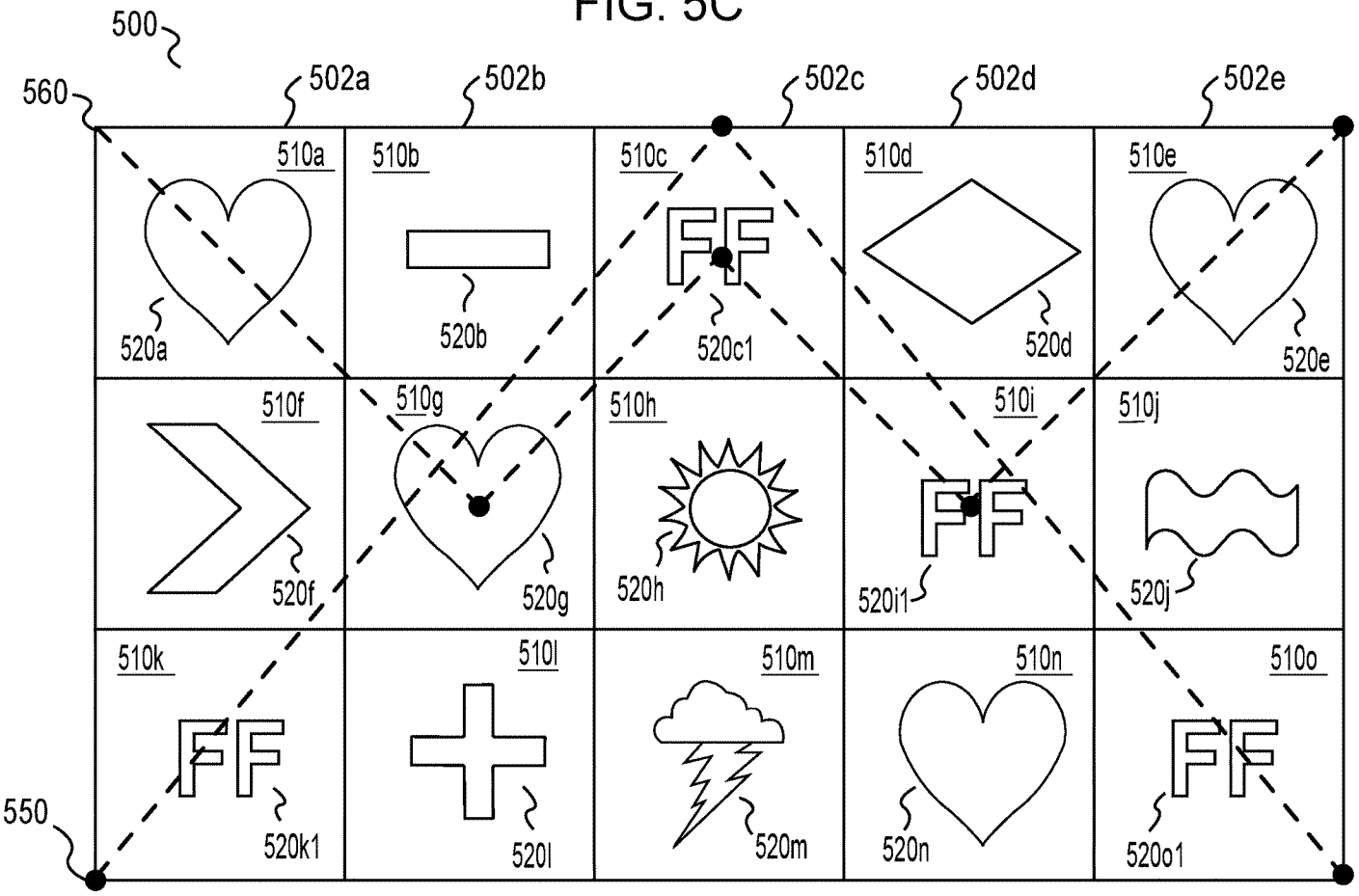

FIGS. 5A, 5B, and 5C illustrate screen shots of one embodiment of a gaming system having a symbol type conversion game.

For purposes of brevity, the play of a game illustrated in FIGS. 5A-5C is similar to a play of a game illustrated in FIGS. 4A-4C and will not be described again in full.

In one embodiment, FIG. 5A may represent a next game played after conclusion of the game described in FIGS. 4A-4C. However, in FIGS. 5A-5C different symbol type conversion displays are illustrated. In FIG. 5A, the gaming system displays a plurality of randomly generated symbols from a set of symbols on reels 502*a*-502*e* after the reels have stopped spinning. Stopped reels 502*a*-502*e* display generated symbols 520*a*-520*o* in symbol display positions 510*a*-510*o*, respectively.

As also illustrated in FIG. 5A, the gaming system generated and displayed heart symbols (520*a*, 520*e*, 520*g*, 520*n*), bar symbol (520*b*), storm symbols (520*c*, 520*i*, 520*k*, 520*o*), diamond symbol (520*d*), chevron symbol (520*f*), sunshine symbol (520*h*), wavy bar symbol (520*j*), cross symbol (520*l*), and lightening symbol (520*m*). All displayed symbols are associated with at least one symbol type. In this embodiment, fourteen pay symbols and one special symbol (diamond) are shown. However, is should be appreciated that the displayed symbol combinations are merely for explanatory purposes and the gaming system may randomly generate any suitable combination of symbols based on one or more sets of symbols. In some embodiments, the gaming system may generate and display symbols associated with the same symbol types.

FIG. 5A illustrates one embodiment of the gaming system performing an evaluation of the generated symbols on reels 502*a*-502*e* and executing game functions to convert game symbols based upon a symbol type conversion mapping. The gaming system may randomly select at least one symbol from the displayed symbols 520*a*-520*o* for a symbol conversion. In the illustrated embodiment of FIG. 5A, the gaming system randomly selected the storm symbol, which is a pay symbol. The gaming system also highlighted the displayed selected storm symbols on display area 500 to notify the player that the storm symbol was selected for a symbol type conversion.

In an alternative embodiment, the gaming system may randomly select the at least one symbol from the set of symbols. If the selected symbol was not generated for at least one of positions 520*a*-520*o*, conversion processing ends and game processing returns to evaluate the set of randomly displayed symbols for generated awards without a symbol type conversion. In one embodiment, the gaming system randomly selects the at least one symbol before the play of the game. In an alternative embodiment, the gaming system randomly selects the at least one symbol during a play of the game. In one such embodiment, the gaming system selects the at least one symbol during a play of the game, but before the gaming system generates the symbols on reels 502*a*-502*e*. In one alternative embodiment, the gaming system selects the at least one symbol during a play of the game, but after the gaming system generates the symbols on reels 502*a*-502*e*. It should be appreciated that the random selection of a symbol for the symbol type conversion can occur at any suitable time.

In one embodiment, the gaming system processor evaluates the symbol type conversion mapping for the storm symbol as illustrated in FIG. 3C. Referring to FIG. 3C, the storm symbol 384 is a pay symbol. When the storm symbol 384 is selected for symbol type conversion, the gaming system converts the storm symbol to an FF symbol 382 which is a special symbol type. In one embodiment, the gaming processor may perform a player-benefit analysis for the conversion as previously discussed. In the example illustrated in FIGS. 3C and 5A, the initial randomly generated symbols do not generate any winning symbol combinations, which results in no award outcomes. When the storm symbol is converted to an FF symbol due to the symbol type conversion, the gaming system determines that at least one winning symbol combination is possible along at least one a pay line. Thus, the gaming system determines that the player benefits from the symbol type conversion and the gaming system processor performs the symbol conversion.

In the embodiment illustrated in FIG. 5B, the gaming system causes a symbol type conversion display to appear for each symbol containing the symbol selected for conversion. In one embodiment, a spinning symbol display may be displayed over the symbols selected for conversion as indicated by arrows 530, 535, 540 and 545 over positions 510*c*, 510*i*, 520*k*, and 510*o* of FIG. 5B. The symbol re-spin display may generate great player excitement and anticipation while the storm symbols are converted into FF symbols. It should be appreciated that a symbol type conversion may be provided in a variety of ways and is not limited to the displayed symbol type conversion. In one embodiment, the gaming system may display a full reel re-spin (as illustrated in FIGS. 4A-4C) where symbols that are not converted reappear in the same symbol display areas while the selected symbol is replaced with the new symbol. This can be accomplished using dynamic reel remapping. In one embodiment, the symbols selected for the symbol type conversion may animate or morph into the conversion symbols. Any suitable symbol type conversion display may be used.

FIG. 5C illustrates one embodiment of a gaming system executing an evaluation of the symbol combinations for winning symbol combinations. As noted above, the player may have wagered on one or more pay lines, which are each evaluated for winning symbol combinations. Any suitable number of pay lines may be used to evaluate winning symbol combinations. While FIG. 5C shows two pay lines for evaluation, additional pay lines are possible.

In the embodiment illustrated in FIG. 5C, the gaming system evaluated one upwardly pointing pay line across positions 510*k* 510*g*, 510*c*, 510*i*, and 510*o*. In this embodiment, five heart symbols across a pay line 550 results in a winning symbol combination. While only one heart symbols 520*g* is displayed on pay line 550, the FF symbols take on the characteristics of the heart symbol in positions 510*k*, 510*c*, 510*i*, and 510*o*. Thus, the gaming system evaluates symbols 520*k*1 520*g*, 520*c*1, 520*i*1, and 520*o*1 as heart symbols for purposes of the gaming system determining winning symbol combinations.

In the embodiment illustrated in FIG. 5C, the gaming system also evaluated a second pay line that zig-zags across the upper two rows of the reels. As shown in FIG. 5C, pay line 560 includes five positions across symbol display positions 510*a* 510*g*, 510*c*, 510*i*, and 510*e*. In this embodiment, five heart symbols displayed on pay line 560 results in a winning symbol combination. While only three heart symbols 520*a*, 520*g*, and 520*e* are displayed along pay line 560, the Flipside Frenzy FF symbols take on the characteristics of the heart symbol in positions, 510*c* and 510*i*. Thus, symbols 520*a*, 520*g*, 520*c*1, 520*i*1, and 520*e* would be evaluated as heart symbols for determining winning symbol combinations.

The winning pay lines are illustrated as pay lines 550 and 560 in FIG. 5C across the reels 502*a*-502*e*. Based on the winning symbol combinations displayed on pay lines 550 and 560, the gaming system awards the appropriate number of credits to the player and updates the player's credit meter to reflect the winnings. The gaming system may display the number of winning credits and may display the player's total credit balance in a display of the gaming system.

The player may continue the gaming session by playing another game. That is, the player may place a wager and start a new play of the game as noted above. However, continued game play is dependent of the number of credits the player has in the player's credit balance. The player may also choose the cash out. In such an instance, the gaming system provides the player a value based on the player's credit balance using any of the value items discussed above (bills, coins, vouchers, etc.)

It should be noted that prior to the symbol type conversion of the storm symbols 520*c*, 520*i*, 520*k*, and 520*o* to the FF symbols 520*c*1, 520*i*1, 520*k*1, and 520*o*1, no symbol combinations were present on any pay lines that would have formed a winning symbol combination from the initially generated symbols on reels 502*a*-502*e* (as illustrated in FIG. 5A). However, the game resulted in two winning symbol combinations for the player due to the gaming system processor's random selection of the storm symbol for symbol type conversion, the symbol type conversion mapping between a storm symbol (a pay symbol) and a Flipside Frenzy symbol (a special symbol), and the gaming system processor's evaluation that symbol type conversion would provide a benefit to the player via payment of a larger award.

FIGS. 6A, 6B, 6C and 6D illustrate screen shots of another embodiment of a gaming system having a symbol type conversion game.

For purposes of brevity, a play of a game illustrated in FIGS. 6A-6D is similar to a play of a game illustrated in FIGS. 4A-4C and therefore will not be described again in full. However, in FIGS. 6A-6D the gaming system randomly selects a plurality of symbols from the set of symbols for the symbol type conversion. In some embodiments, the symbol type conversion is not applied to all generated symbols for a play of the game. In the embodiment illustrated in FIG. 6A, the gaming system includes five reels, but may apply the symbol type conversion for one of the randomly selected symbols to one subset of the five reels, while applying the symbol type conversion for a different one of the randomly selected symbols to a different subset of the five reels. The increased selections of symbols for symbol type conversion further enhances game play.

Figure 6A:
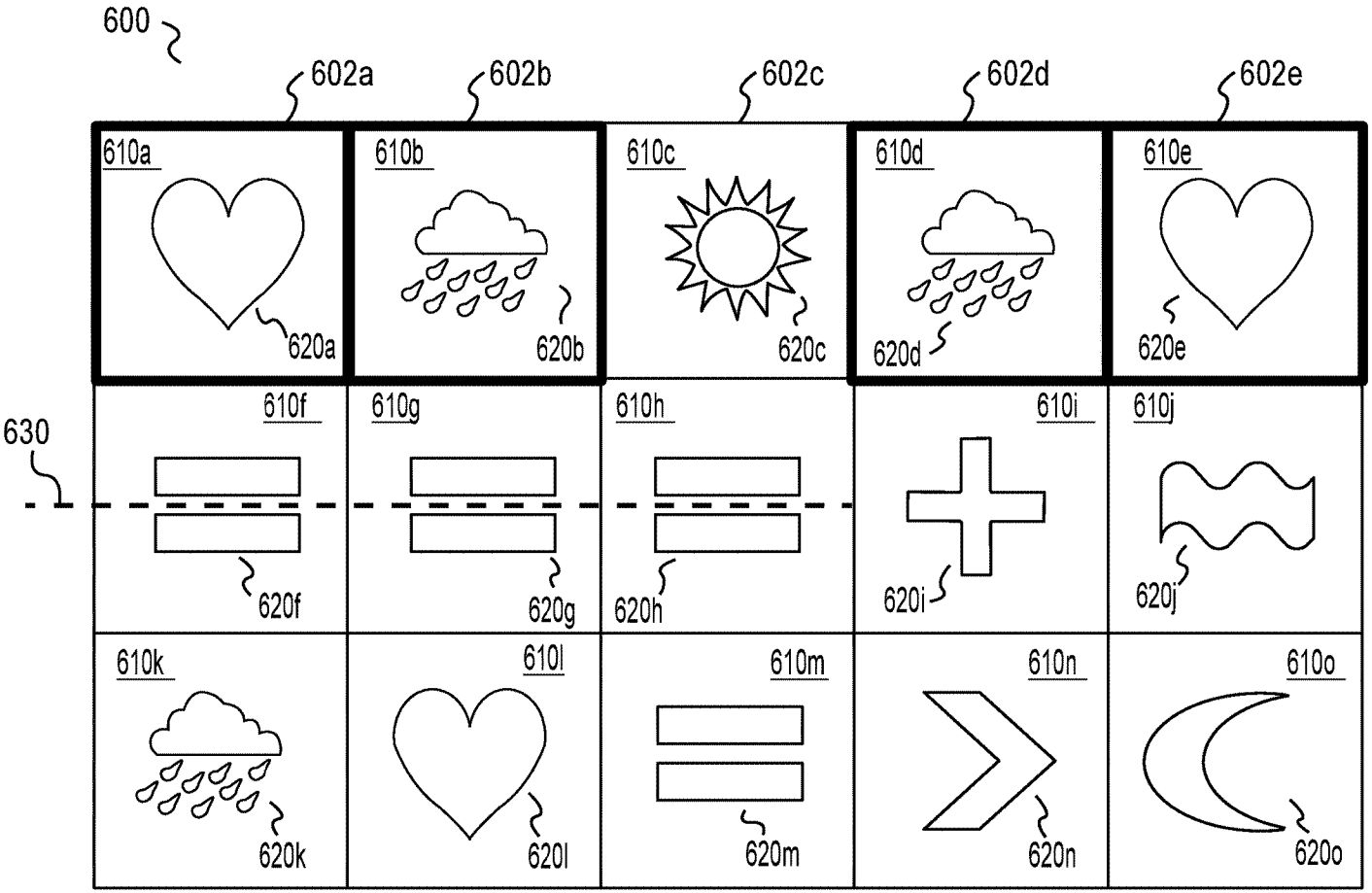
FIGS. 6A, 6B, 6C, and 6D illustrate screen shots of another embodiment of a gaming system having a first symbol type conversion applied to a first set of reels and a second symbol type conversion applied to a second set of reels.

In FIG. 6A the player has wagered on a play of a game and the gaming system executed a play of a game in a manner like the process discussed in connection with FIGS. 4A-4C. As illustrated in FIG. 6A, the gaming system shows a display of a plurality of randomly determined symbols from a first set symbols on reels 602*a*-602*e* after the reels have stopped spinning. Stopped reels 602*a*-602*e* contains symbols 620*a*-620*o* in symbol display positions 610*a*-610*o*, respectively.

As also illustrated in FIG. 6A, the gaming system generated and displayed heart symbols (620*a*, 620*e*, 620*l*), storm symbols (620*b*, 620*d*, 620*k*,), sunshine symbol (620*c*), double bar symbols (620*f*, 620*g*, 620*h*, 620*m*), cross symbol (620*i*), wavy bar symbol (620*j*), chevron symbol (620*n*), and moon symbol (620*o*). All displayed symbols are pay symbols. In this embodiment, fifteen pay symbols are shown. However, is should be appreciated that the displayed symbol combinations are merely for explanatory purposes and the gaming system may randomly generate any suitable combination of symbols based on defined symbol sets. In some embodiments, the gaming system may generate and display symbols associated with different symbol types.

In one embodiment, the gaming system processor may randomly select more than one symbol from the set of symbols for symbol type conversion, as described above. In some embodiments, the gaming system may use one or more symbol type conversion maps to convert symbol types in a game. In the embodiment of FIGS. 6A-6D, the gaming system processor randomly selected a first symbol and a second symbol from the set of symbols for symbol type conversion. The gaming system may associate the selected first symbol with a first subset of the five reels. For example, the gaming system associated the selected first symbol is associated with reels 602*a*, 603*c*, and 602*e* for the symbol type conversion. The gaming system may associate the selected second symbol with a second subset of the five reels, where the second subset of the five reels includes different reels from the first subset of five reels. For example, the gaming system associated the selected second symbol with reels 602*b* and 602*d* for the symbol type conversion. In the embodiments of FIGS. 6A-6D, the gaming system uses one symbol type conversion mapping to determine how to convert the selected first symbol and the selected second symbol.

It should be appreciated that, in some embodiments, one or more different symbol type conversion mappings may be used. For example, a different symbol type conversion mapping may be applied to the second subset of the five reels. In such an embodiment, many different results can be achieved. For example, if one symbol was selected for the symbol type conversion, but different symbol mappings were applied to different reels, the same one symbol could be converted into two different symbols due to the different mappings. However, for purposes of brevity, the same symbol type conversion mapping is utilized in illustrating the symbol conversion concepts in FIGS. 6A-6D.

In the embodiment of FIG. 6A, the gaming system processor randomly selected the heart symbol as the selected first symbol for a symbol type conversion on reels 602*a*, 602*c*, and 602*e*. The processor also selected the storm symbol as the selected second symbol for a symbol type conversion on reels 602*b* and 602*d*. In FIG. 6A, the gaming system evaluated the reels for occurrences of the symbol heart and the storm symbol in the appropriately assigned reels. The gaming system also highlighted around the respective border positions 610*a*, 620*b*, 601*d*, and 610*e* due to the appearance of the heart symbol and the storm symbol. It should be appreciated that the gaming system may not highlight the border in some embodiments. However, in some embodiments, any symbol selected for conversion may be highlighted in any suitable manner to the player prior to displaying the symbol type conversion to increase the player's anticipation and excitement.

In FIG. 6A, the heart symbol appears on reels 602*a*, 602*b*, and 602*c*. However, reel 602*b* is not under consideration for symbol type conversion of the heart symbol due to the association of the heart symbol for conversion with conversion on reels 602*a*, 602*c*, and 602*e*. Thus, in this embodiment, the heart symbol in symbol display area 620*l* is not converted. To perform the symbol type conversion, the gaming system processor may refer to the symbol type conversion map shown in FIG. 3C. As illustrated in the symbol mapping in FIG. 3C, if the heart symbol is selected for conversion, the gaming system converts the heart symbol (a pay symbol) to an FF symbol (a special symbol). In one embodiment, the gaming system may then perform a player-benefit analysis for the symbol conversion.

Figure 6B:
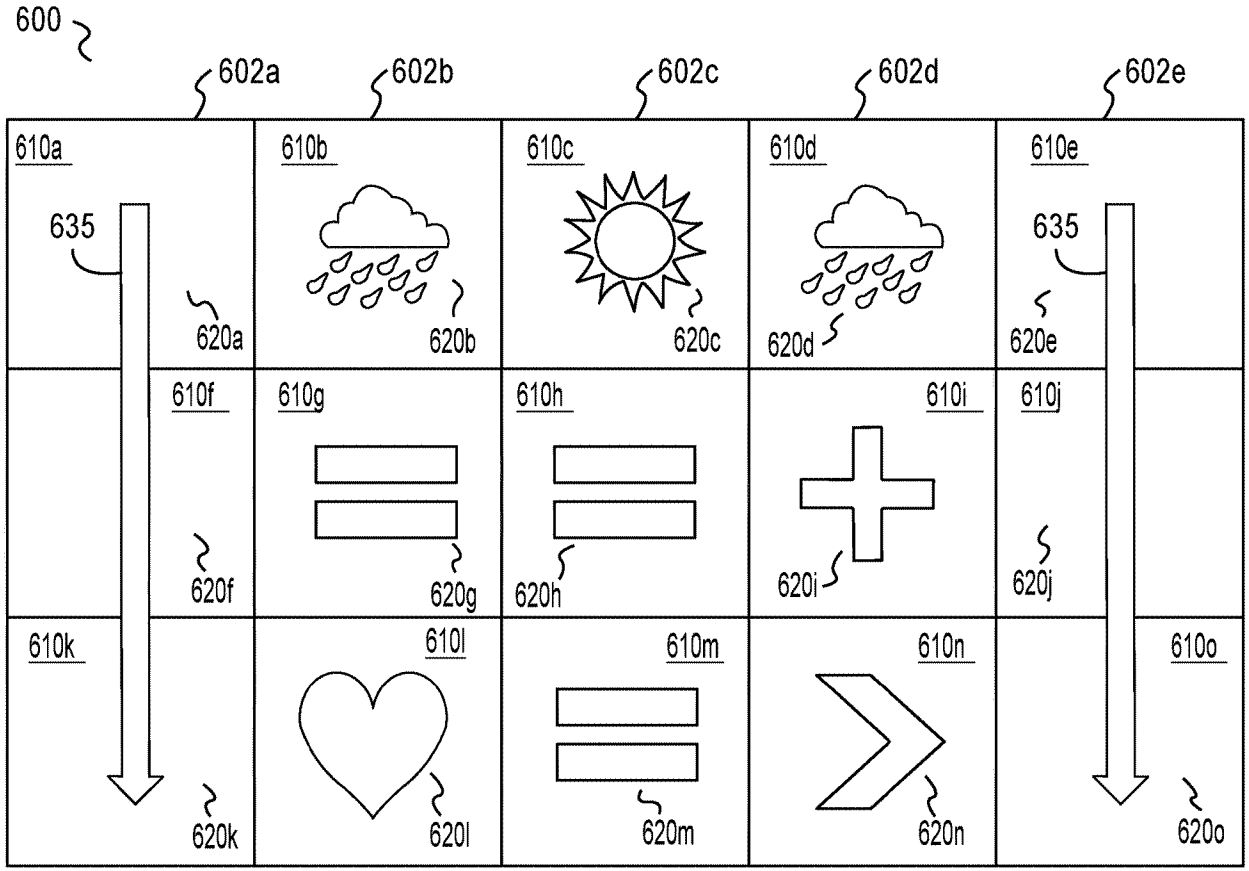

In this example, one pay award may be generated as a result of the initial reel spin (i.e. a combination of symbols generates an award prior to a symbol type conversion). Double bar symbols 620*f*, 620*g*, and 620*h* may create an award payout, indicated by payout line 630 of FIG. 6A. The gaming system processor evaluates the symbol type conversion from a heart symbol to an FF symbol in reels 602*a* and 602*e* for a player benefit. If the heart symbol is converted to a FF symbol on reels 602*a* and 602*e*, the gaming system determines that at least one winning symbol combination is still possible along at least one a pay line. Thus, the gaming system determines that the player benefit from the symbol conversion and the gaming system processor performs the symbol conversion. As illustrated in FIG. 6B, the conversion will create an additional award as the FF symbol in position 610*a* will be evaluated as a double bar symbol and combine with the double bar symbols in symbol display areas 610*g* and 610*m* to form an additional award.

The gaming system processor also evaluates the second symbol conversion applied to reels 602*b* and 602*d*. The gaming system processor selected the storm symbol for conversion on reels 602*b* and 602*d*. The gaming system evaluates the generated symbols and determines that the storm symbol appears in positions 620*b*, 620*d*, and 620*k* of the stopped reels. While the storm symbol 620*k* appears in symbol display area 620*k* on reel 602*a*, storm symbol 620*k* is not under consideration for symbol type conversion because the selected second symbol is associated with reels 602*b* and 602*d*. The gaming system processor determines storm symbols convert to FF symbols based on the symbol type conversion map of FIG. 3C and evaluates the symbol type conversion benefits to the player.

In this example, as previously described, the symbol combination of adjacent double bar symbols 620*f*, 620*g*, and 620*h* created an initial award and the conversion of the selected heart symbol to a FF symbol on reels 602*a*, 602*c*, and 602*e* also created an award. In some embodiments, the gaming system processor will evaluate whether an additional symbol conversion on reels 602*b* and 602*d* would detrimentally impact the existing and additional award(s) from other reel symbol conversions. In other words, a symbol type conversion benefit evaluation may consider awards existing prior to additional symbol type conversion as well as any awards that may arise due to additional symbol type conversions.

In the embodiment of FIG. 6A, the processor determines that the symbol type conversion will create an additional award because FF symbols in symbol display areas 610*b* and 620*d* will be evaluated as sunshine symbols, creating at least three adjacent sunshine symbols. In addition, the prior evaluation of converting heart symbols to FF symbols in positions 610*a* and 610*e* will also be evaluated as additional sunshine symbols. When both selected symbols are converted, five sunshine symbols are possible across positions 610*a*-610*e*. Thus, the gaming system may proceed with the symbol type conversions of both selected symbols because the symbol type conversions all result in increased benefits to the player.

Figure 6C:
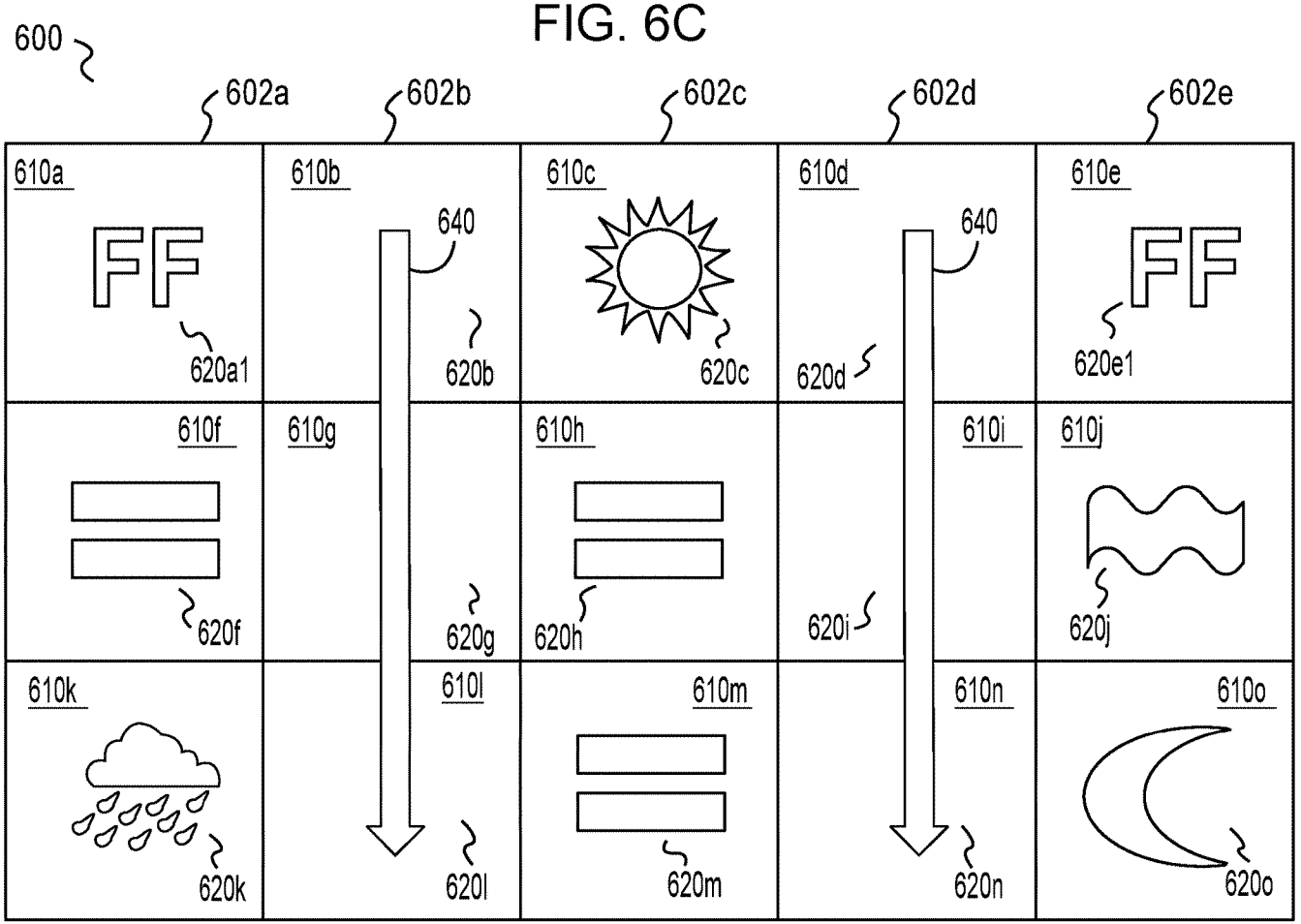

In the embodiment illustrated in FIGS. 6B and 6C, the gaming system causes a symbol type conversion display to appear for each reel containing the selected first symbol for symbol type conversion. In one embodiment, a spinning reel display may be displayed for reels 602*a* and 602*e* as indicated by arrows 635 of FIG. 6B. In a like manner, a spinning reel display may be displayed for reels 602*b* and 602*d* as indicated by arrows 640 of FIG. 6C. It should be appreciated that a symbol conversion may be provided in a variety of ways. In one embodiment, the gaming system may display a reel re-spin where symbols that are not converted reappear in the same symbol display areas while the selected symbols are replaced with new symbols in accordance with the symbol type conversion mapping. This can be accomplished using dynamic remapping of symbols on the reels. The reel re-spin display may generate great player excitement and anticipation while the first heart symbol and second storm symbol are converted into FF symbols on the respective reels.

It should be noted that a symbol type conversion may be provided in a variety of ways. In one embodiment, reels may display a reel re-spin where symbols not affected by conversion are re-displayed in the same position and the converted symbols are displayed in the place of the selected symbols for symbol type conversion. In one embodiment, symbols selected for symbol type conversion may animate or morph into converted symbols. In one embodiment, reels 602*a*, 602*c*, and 602*e* may display the symbol type conversion before or after reels 602*b* and 602*d* display their symbol type conversion. In one embodiment, all reels may display the symbol type conversions at the same time. In yet another embodiment, the reels may all spin in one unified direction. In another embodiment, reels associated with one symbol selected for symbol type conversion may spin in one direction while reels associated with another symbol selected for symbol type conversion may spin in the opposite direction.

Figure 6D:
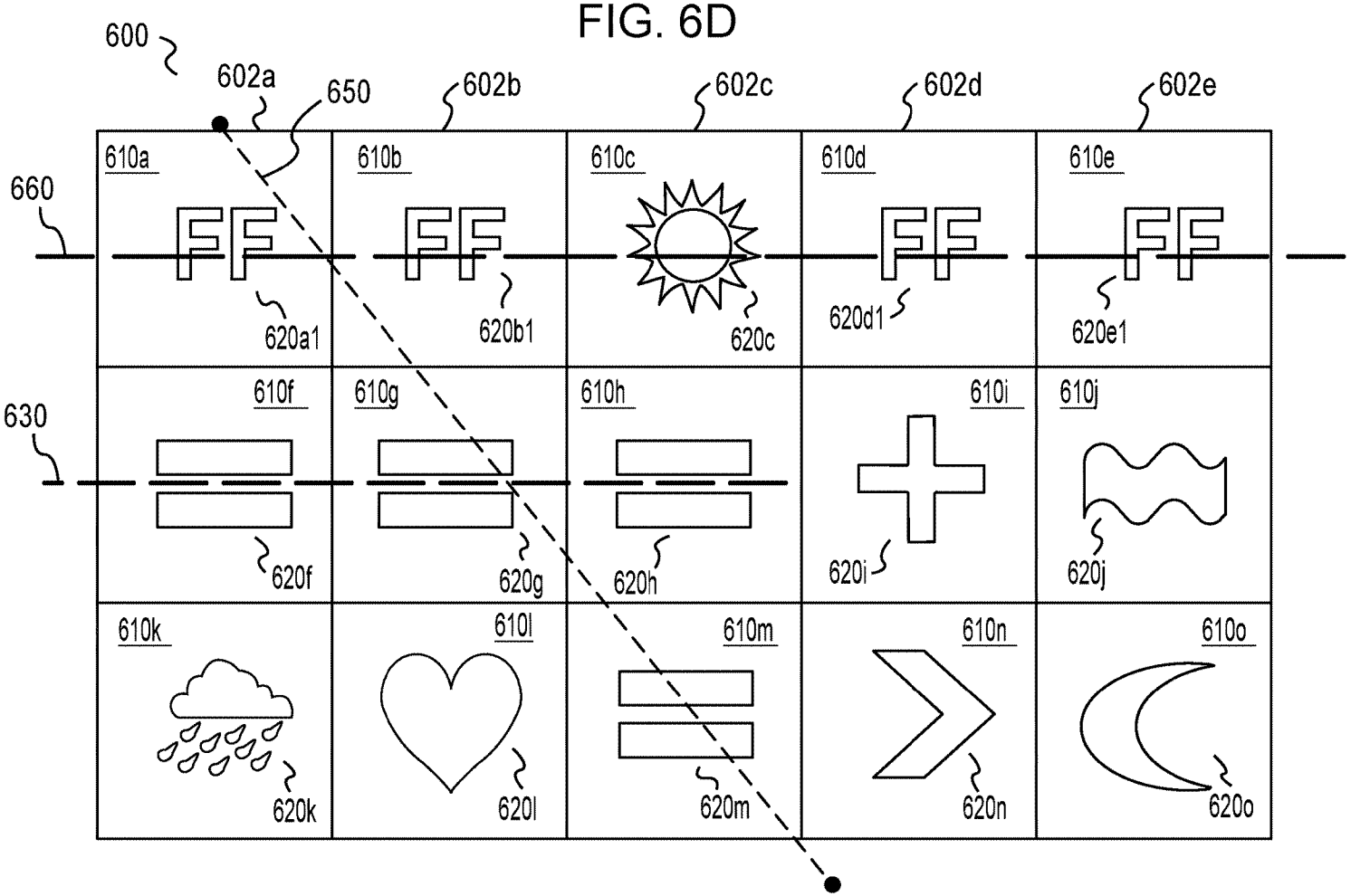

In the embodiment illustrated in FIG. 6D, the gaming system evaluated pay line 630 that combines symbols 620*f*, 620*g*, 620*h* for a winning symbol combination of three double bar symbols as existed prior to the symbol type conversions. The gaming system evaluated pay line 650 that combines symbols 620*a*1, 620*g*, and 620*m* for a winning symbol combination of three double bar symbols because the Flipside Frenzy symbol 620*a*1 mimicked the other double bar symbols for winning symbol combination evaluation purposes. The gaming system also evaluated pay line 660 that combines symbols 610*a*1, 610*b*1, 610*c*, 610*d*1, and 610*e*1 for a winning symbol combination of five sunshine symbols. In the illustrated embodiment, the Flipside Frenzy symbols in positions 620*a*1, 620*b*1, 620*d*1, and 620*e*1 mimicked the sunshine symbol 620*c*.

Based on the winning symbol combination displayed along the pay lines 630, 650 and 660, the gaming system awards the appropriate number of credits to the player and updates the player's credit balance to reflect the winnings. The gaming system may display the number of winning credits and may display the player's total credit balance in a display of the gaming system.

The player may continue the gaming session by playing another game as discussed above. However, continued game play is dependent of the number of credits the player has in the player's credit balance. If not enough credits are available in the player's credit balance, the game system may enable the player to insert additional value to replenish the player's credit balance. The player may also choose to cash out. In such an instance, the gaming system provides the player a value based on the player's credit balance using any of the value items discussed above (bills, coins, vouchers, etc.)

It should be appreciated that the symbol type conversion increases anticipation for game players for the game outcome. Even if no matches are determined after an initial generation of symbols or after an initial spin of a set of game reels, the symbol type conversion can dramatically alter the winning symbol combinations formed after the initial symbols are generated.

By randomly selecting symbols and converting the selected symbols when the conversion benefits a player, the gaming system described herein creates a new level of game element interactions within a game. This also adds a new level of anticipation and excitement for game players.

In addition, when the result of a symbol type conversion benefit evaluation indicates no benefit to the player, the symbol type conversion analysis may cease and the gaming system moves forward to evaluate awards based upon the symbol combinations displayed without the symbol type conversion. Moving forward without further conversion analysis or display reduces gaming system processing by eliminating needless screen displays of symbol type conversions that do not produce a player benefit. In this manner, game play delay is reduced and increases the efficiency of the gaming system. In addition, a player comes to understand that when the gaming system displays a symbol type conversion, the player will not be harmed and will likely benefit. Player anticipation of symbol type conversion is greatly enhanced.

The symbol type conversion gaming method depends on the symbol or type of symbol rather than the position of the symbol. Thus, the more of the same symbol type that appears on the reels, the greater the possibility of a big win. A player may anticipate, after the initial spin, that certain symbol types may convert to other symbol types for the player's benefit. This gaming system and method greatly increases player anticipation and excitement.

A number of embodiments of the invention have been described. Various modifications may be made without departing from the spirit and scope of the invention. For example, various forms of the flows shown above may be used, with steps re-ordered, added, or removed. Accordingly, other embodiments are within the scope of the following claims.

We claim:

1. A gaming system comprising:

a cabinet;

a processor;

a display device supported by the cabinet;

an input device supported by the cabinet;

a value acceptor supported by the cabinet;

a value dispenser supported by the cabinet;

a memory device that stores a plurality of instructions which, when executed by the processor, cause the processor to:

establish a credit balance based at least in part on a monetary value received by the value acceptor;

place a wager following receipt of a wager input via the input device, the credit balance being decreased by the wager;

cause the display device to display a symbol display area;

display, in the symbol display area, a plurality of randomly generated symbols from a set of symbols, wherein each symbol of the set of symbols is associated with a symbol type and wherein the set of symbols includes a plurality of different symbol types;

randomly select a first symbol from the set of symbols based on the symbol type of the first symbol, wherein the random selection of the first symbol is independent of a position of the first symbol;

determine if the randomly selected first symbol is displayed in the symbol display area;

if the first symbol is displayed in the symbol display area, convert at least one displayed first symbol into a second symbol of the set of symbols based upon the symbol type of the second symbol;

display the second symbol with the plurality of randomly generated symbols in the symbol display area;

determine any award based on all displayed symbols in the symbol display area and the wager;

cause the display device to display the determined award;

cause the credit balance to be increased by the determined award; and issue value from the value dispenser based on the credit balance upon receipt of a cash out signal via the input device.

2. The gaming system of claim 1, wherein the first symbol is associated with a first symbol type and the second symbol is associated with a second symbol type, wherein the first symbol type is different from the second symbol type.

3. The gaming system of claim 1, wherein the first symbol type is a pay symbol and the second symbol type is a special symbol.

4. The gaming system of claim 3, wherein the pay symbol is a symbol type that is associated with a value that used to determine an award amount.

5. The gaming system of claim 3, wherein the special symbol is a symbol type that is associated with at least one game function.

6. The gaming system of claim 5, wherein the at least one game function is an award multiplier.

7. The gaming system of claim 1, wherein the first symbol and the second symbol are associated with a same symbol type.

8. The gaming system of claim 1, wherein the conversion of the at least one displayed first symbol into the second symbol is based on a predetermined mapping between a pair of symbols in the set of symbols.

9. The gaming system of claim 8, wherein the predetermined mapping is determined prior to a play of a game.

10. The gaming system of claim 8, wherein the predetermined mapping is determined during a play of a game.

11. The gaming system of claim 1, wherein the conversion of the at least one displayed first symbol into the second symbol is based on a randomly determined mapping between a pair of symbols in the set of symbols.

12. The gaming system of claim 1, wherein the processor further evaluates a benefit of converting the first symbol into the second symbol.

13. The gaming system of claim 12, wherein the benefit further includes the processor determining whether the conversion of the first symbol into the second symbol will result in a new award that is greater than any determined award that would have been provided if the first symbol was not converted into the second symbol.

14. The gaming system of claim 1, wherein the processor further:

randomly selects a third symbol from the set of symbols based on the symbol type of the third symbol;

determines if the third symbol is displayed in the symbol display area; and if the third symbol is displayed in the symbol display area, convert at least one displayed third symbol into a fourth symbol of the set of symbols based upon the symbol type of the fourth symbol.

15. The gaming system of claim 14, wherein the symbol display area includes at least two gaming reels and wherein the second symbol is displayed on at least one gaming reel and the fourth symbol is displayed on a different one of the at least two gaming reels.

16. The gaming system of claim 1, wherein the conversion of the at least one displayed first symbol into the second symbol is based on one of a plurality of different mappings between pairs of symbols in the set of symbols.

17. The gaming system of claim 16, wherein the plurality of different mappings comprise a first mapping and a second mapping, wherein the processor uses the first mapping to convert at least one first symbol into a second symbol and the processor uses the second mapping to convert another one of the at least first symbol into a third symbol.

18. The gaming system of claim 17, wherein the symbol display area includes at least two gaming reels, wherein the processor further applies the first mapping to at least one first symbol displayed on a first gaming reel of the at least two gaming reels and applies the second mapping to another one of the at least one first symbol displayed on a second gaming reel of the at least two gaming reels.

19. A method of operating a gaming system, the method comprising:

receiving, by a monetary value acceptor, a monetary value;

establishing, by a processor of the gaming system, a credit balance based at least in part on the received monetary value;

accepting, from an input device in a housing of the gaming system, a wager amount;

decreasing, by the processor, the credit balance by the wager amount;

displaying, on a display device of the housing, a symbol display area;

displaying, in the symbol display area, a plurality of randomly generated symbols from a set of symbols, wherein each symbol of the set of symbols is associated with a symbol type and wherein the set of symbols includes a plurality of different symbol types;

randomly selecting a first symbol from the set of symbols based on the symbol type of the first symbol, wherein the random selection of the first symbol is independent of a position of the first symbol;

determining if the randomly selected first symbol is displayed in the symbol display area;

if the first symbol is displayed in the symbol display area, converting at least one displayed first symbol into a second symbol of the set of symbols based upon the symbol type of the second symbol;

displaying the second symbol with the plurality of randomly generated symbols in the symbol display area;

determining, by the processor, any award based on all displayed symbols in the symbol display area and the wager;

displaying, on the display device, any determined award;

increasing, by the processor, the credit balance by the determined award; and issuing another monetary value, by a value dispenser, based on the credit balance upon receipt of a cash out signal via the input device of the gaming system.

20. A non-transitory computer-readable storage medium having machine instructions stored therein, the instructions being executable by a processor to cause the processor to:

establish a credit balance based at least in part on a monetary value received by a value acceptor;

place a wager following receipt of a wager input via an input device, the credit balance being decreased by the wager;

cause a display device to display a symbol display area;

display, in the symbol display area, a plurality of randomly generated symbols from a set of symbols, wherein each symbol of the set of symbols is associated with a symbol type and wherein the set of symbols includes a plurality of different symbol types;

randomly select a first symbol from the set of symbols based on the symbol type of the first symbol, wherein the random selection of the first symbol is independent of a position of the first symbol;

determine if the randomly selected first symbol is displayed in the symbol display area;

if the first symbol is displayed in the symbol display area, convert at least one displayed first symbol into a second symbol of the set of symbols based upon the symbol type of the second symbol;

display the second symbol with the plurality of randomly generated symbols in the symbol display area;

determine any award based on all displayed symbols in the symbol display area and the wager;

cause the display device to display the determined award;

cause the credit balance to be increased by the determined award; and issue value from a value dispenser based on the credit balance upon receipt of a cash out signal via the input device.

* * * * *